US011420790B2

(12) United States Patent
Neeld

(10) Patent No.: US 11,420,790 B2
(45) Date of Patent: Aug. 23, 2022

(54) MODULAR CARGO SYSTEM

(71) Applicant: Doubleday Acquisitions LLC, Dayton, OH (US)

(72) Inventor: Jonathan Peter Neeld, Centerville, OH (US)

( * ) Notice: Subject to any disclaimer, the term of this patent is extended or adjusted under 35 U.S.C. 154(b) by 0 days.

(21) Appl. No.: 17/034,884

(22) Filed: Sep. 28, 2020

(65) Prior Publication Data

US 2022/0097907 A1 Mar. 31, 2022

(51) Int. Cl.
*B65D 19/00* (2006.01)
*B65D 19/38* (2006.01)

(52) U.S. Cl.
CPC ..... *B65D 19/004* (2013.01); *B65D 19/38* (2013.01); *B65D 19/385* (2013.01); *B65D 2519/00069* (2013.01); *B65D 2519/0096* (2013.01); *B65D 2519/00268* (2013.01); *B65D 2519/00273* (2013.01); *B65D 2519/00288* (2013.01); *B65D 2519/00308* (2013.01); *B65D 2519/00318* (2013.01); *B65D 2519/00323* (2013.01); *B65D 2519/00338* (2013.01); *B65D 2519/00711* (2013.01)

(58) Field of Classification Search
CPC .... B65D 19/004; B65D 19/38; B65D 19/385; B65D 2519/00069
USPC ..... 108/55.3, 55.1, 51.11–57.34
See application file for complete search history.

(56) References Cited

U.S. PATENT DOCUMENTS 3,850,295 A * 11/1974 Black ..... B65D 85/06 206/304
4,000,704 A * 1/1977 Griffin, Jr. ..... B65D 19/004 108/53.1
4,480,748 A * 11/1984 Wind ..... B65D 19/0018 108/55.3
4,700,959 A * 10/1987 Lars ..... B62B 3/00 108/56.1

(Continued)

FOREIGN PATENT DOCUMENTS

DE 29513797 U1 10/1995
DE 19506172 A1 8/1996

(Continued)

OTHER PUBLICATIONS

International Search Report and Written Opinion dated Dec. 23, 2021, for International Application No. PCT/US2021/052147, 16 pages.

*Primary Examiner* — Jose V Chen
(74) *Attorney, Agent, or Firm* — Frost Brown Todd LLC

(57) ABSTRACT

A system for palletizing cargo includes a number of components that may be combined to produce an assembled pallet of cargo. A pallet base provides a cargo area where a payload may be stacked. The pallet base includes protective features such as feet that raise the payload above surface level, bumpers that prevent and absorb impacts to the pallet base, and a rim that encircles the cargo area. A pallet top is placed on top of the payload, opposite the pallet base, and a set of straps are used to connect the pallet base to the pallet top and friction fit the payload therebetween. Each of the base and top include a series of holes and spacers that allow (Continued)

airflow to pass around the bottom and top of the payload, while the bumpers allow airflow around the sides, even when the assembled pallets are surrounded by other cargo.

20 Claims, 15 Drawing Sheets

(56) References Cited

U.S. PATENT DOCUMENTS 5,029,734 A * 7/1991 Nichols ..... B65D 45/18 222/105
5,052,307 A * 10/1991 Morrison ..... B65D 19/38 108/53.1
5,076,175 A * 12/1991 Whatley, II ..... B65D 19/38 108/51.11
5,097,951 A * 3/1992 Pigott ..... B65D 19/44 108/55.3
5,388,702 A 2/1995 Jones
5,673,629 A * 10/1997 Ginnow ..... B65D 19/0095 108/56.1
6,192,807 B1 * 2/2001 Mason ..... B65D 19/0002 108/27
6,260,487 B1 * 7/2001 Giorgio ..... B65D 19/38 108/51.11
6,408,768 B1 * 6/2002 Giampavolo ..... B65D 19/38 108/27
6,463,863 B1 * 10/2002 Ishikawa ..... B65D 19/385 108/53.1
6,530,476 B1 * 3/2003 Overholt ..... B65D 71/0096 108/55.3
7,219,609 B1 * 5/2007 Utz ..... B65D 19/44 108/55.3
8,077,040 B2 * 12/2011 Muirhead ..... G06K 19/07792 340/572.1
8,267,262 B2 * 9/2012 Thelwell ..... E01F 15/141 211/183
8,424,467 B2 * 4/2013 Giampavolo ..... B65D 19/38 108/51.11
8,505,467 B1 * 8/2013 Roberts ..... B65D 81/054 108/51.11
8,789,475 B1 * 7/2014 Giampavolo ..... B65D 19/38 108/27
9,016,212 B2 * 4/2015 Valiulis ..... B65D 19/0095 108/51.11
9,352,876 B2 * 5/2016 Muirhead ..... B65D 19/0012
10,118,732 B2 * 11/2018 Segerstrom ..... B65D 19/0093
11,001,412 B2 * 5/2021 Hawley ..... B65D 19/0085
2004/0094496 A1 * 5/2004 MacDonald ..... A47B 91/00 211/189
2005/0188901 A1 * 9/2005 Arai ..... B65D 19/44 108/53.1
2005/0260055 A1 11/2005 Facey et al.
2007/0245932 A1 * 10/2007 Nielsen ..... B65D 19/0093 108/51.11
2008/0103944 A1 5/2008 Hagemann et al.
2008/0178775 A1 * 7/2008 Strobl ..... B65D 19/0012 108/57.26
2011/0303129 A1 * 12/2011 Harris ..... A47B 87/0215 108/53.1
2014/0283714 A1 * 9/2014 Wahl ..... B65D 19/0014 108/51.11
2016/0023803 A1 * 1/2016 Green ..... B65D 19/0095 108/57.12
2016/0039568 A1 * 2/2016 Huber ..... B65D 19/0002 108/55.3
2016/0200478 A1 * 7/2016 Noe ..... B64D 9/00 108/55.3
2016/0264292 A1 9/2016 Schoening

FOREIGN PATENT DOCUMENTS

DE 102010016309 A1 10/2011
GB 734002 A 7/1955
GB 2300622 A 11/1996
WO WO 2012/010138 A1 1/2012

* cited by examiner

MODULAR CARGO SYSTEM

FIELD

The disclosed technology pertains to a modular system for packing and transporting cargo.

BACKGROUND

Cargo is frequently transported in palletized loads that are assembled to immobilize, secure, and protect the contained goods. The particular components of a palletized load may vary by the type of good that is being transported, but may include wooden cargo pallets, stacked goods, metal tie down straps or cables, and plastic wrap. Types of cargo transported via pallet may include bulk goods being shipped to distributors or retail locations, components or materials being shipped to a manufacturer, and appliances being shipped to residential homes.

Conventional palletization materials and methods are associated with a number of disadvantages. Assembling a cargo pallet is time consuming and costly, and may require an assembler to stack cargo, attach metal tie down straps, and wrap most or all of the goods and pallet in several layers of plastic wrap. These materials provide little protection against impacts against the goods or pallet, and are also largely disposable and only suitable for a single use or a small number of uses. Wood pallets may be used several times in some cases, while metal tie straps and plastic wrap are typically cut away from the pallet and disposed upon delivery.

Conventional palletized cargo also cannot be stacked due to instability and crush potential for supporting loads, and instead may be packed tightly together (e.g., with wooden pallets pushed edge-to-edge). While such tight packing may provide some benefits in immobilizing the palletized goods, it may be disadvantageous for cargo that requires climate-controlled airflow around and between pallets.

What is needed, therefore, is an improved system for palletizing cargo.

BRIEF DESCRIPTION OF THE DRAWINGS

The drawings and detailed description that follow are intended to be merely illustrative and are not intended to limit the scope of the invention as contemplated by the inventors.

DETAILED DESCRIPTION

The inventors have conceived of novel technology that, for the purpose of illustration, is disclosed herein as applied in the context of cargo transport systems. While the disclosed applications of the inventors' technology satisfy a long-felt but unmet need in the art of cargo transport systems, it should be understood that the inventors' technology is not limited to being implemented in the precise manners set forth herein, but could be implemented in other manners without undue experimentation by those of ordinary skill in the art in light of this disclosure. Accordingly, the examples set forth herein should be understood as being illustrative only, and should not be treated as limiting.

Figure 1:
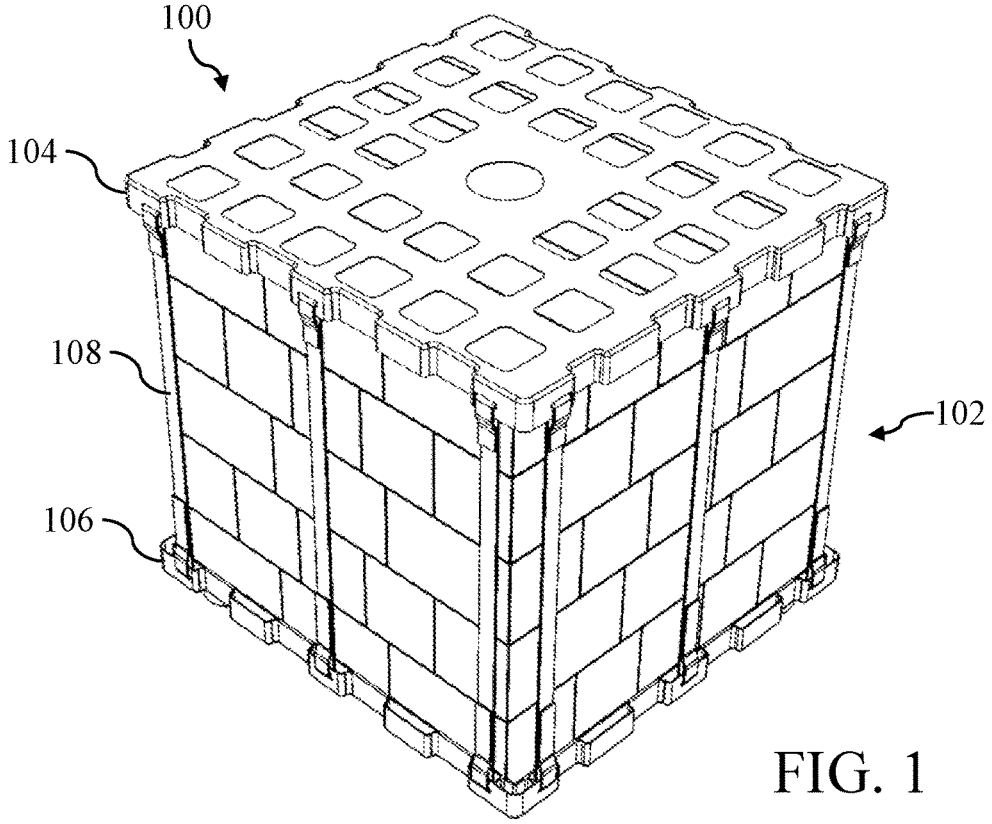
FIG. 1 is a perspective view of an exemplary assembled pallet.

FIG. 1 is a perspective view of an exemplary assembled pallet (100). The assembled pallet (100) includes a pallet base (106) on which a payload (102) may be stacked or arranged. The payload (102) is depicted as a set of stacked boxes, but it should be understood that the payload (102) may contain objects of varying shapes and sizes, and may not fully occupy the entire area of the pallet base (106). A pallet top (104) is positioned on top of the payload (102) opposite the pallet base (106), and a set of straps (108) are placed to connect the pallet top (104) to the pallet base (106). When the straps (108) are applied they may be tightened (e.g., by hand with friction fittings, with Velcro, with a ratcheting system, or the like) in order to place the pallet top (104), the payload (102), and the pallet base (106) into a state of compression such that the pallet top (104) and pallet base (106) are held in a fixed position relative to each other, and the payload (102) is friction fit and immobilized in between.

An additional advantage of the strap (108) used as shown in FIG. 1 is that the pulling/compressing force of each strap is applied along a vertical axis. This differs from palletization techniques that use a single strap that connects on one side of a pallet, wraps over top of the payload, and connects to the opposite of the pallet. In such configurations, the compression force of the tightened strap will be applied along varying axes, especially at the top edges where the strap wraps around the payload and changes directions at a near 90-degree angle. In such cases, as the strap is tightened the payload is compressed against the pallet, but much of the force is also applied to top edge of the payload which may result in crushing and damage to the payload.

Figure 2:
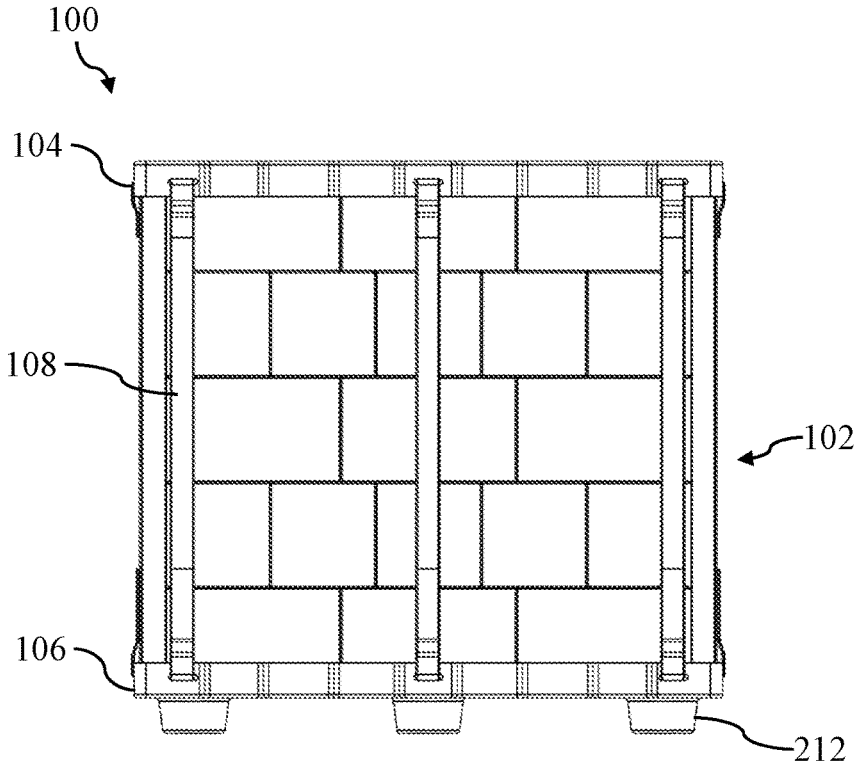
FIG. 2 is a side elevation view of the assembled pallet of FIG. 1.
Figure 3:
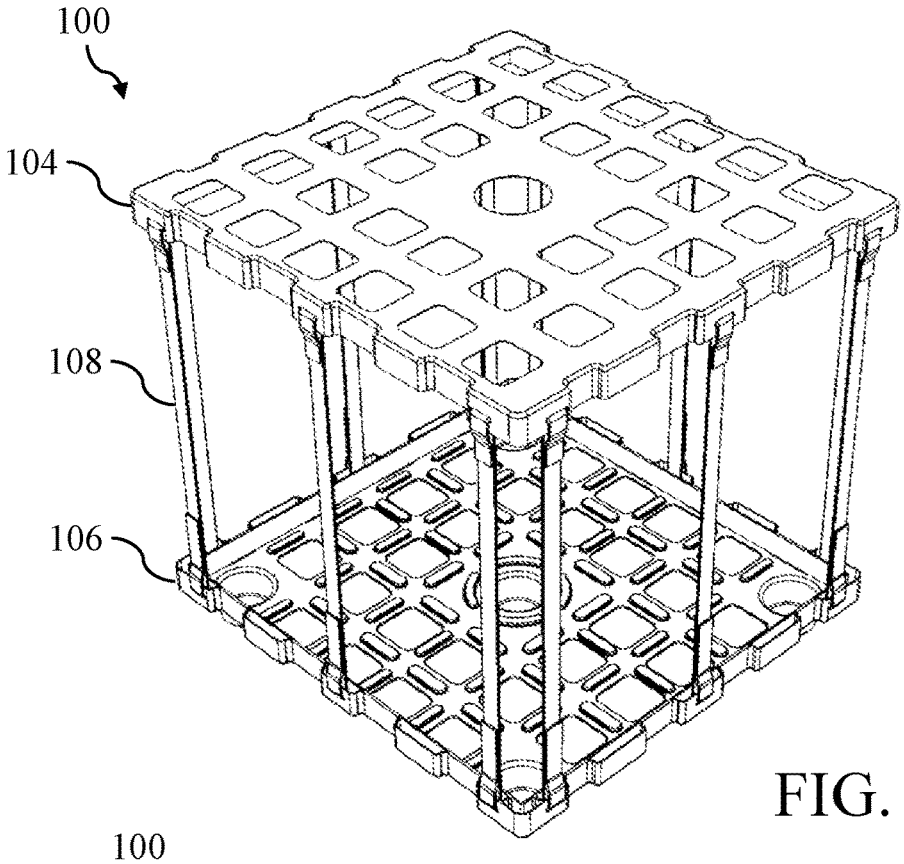
FIG. 3 is a perspective view of an exemplary set of palletizing components used in the assembled pallet of FIG. 1.
Figure 4:
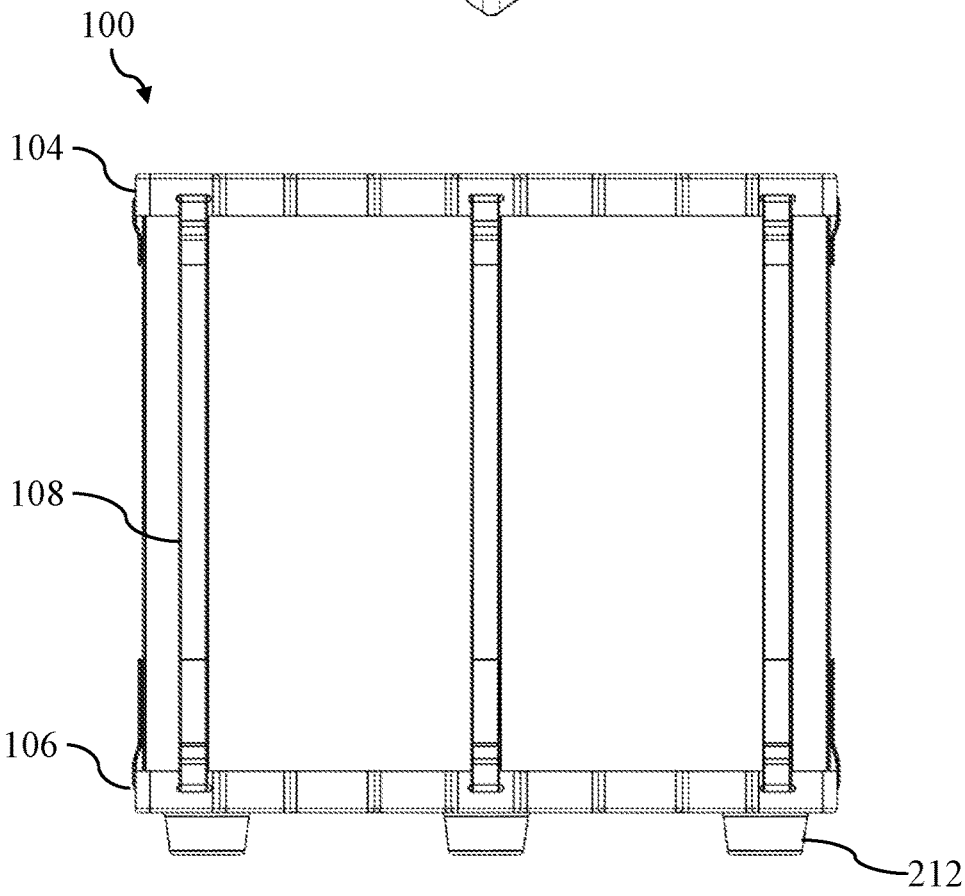
FIG. 4 is a side elevation view of the set of palletizing components of FIG. 3.

FIG. 2 shows a side elevation view of the assembled pallet (100), where a set of feet (212) can also be seen. The feet (212) elevate the payload (102) and provide some protection against surface hazards (e.g., dirt, or even several inches of standing water), and also allow for airflow beneath the payload (102) which may be advantageous for payloads (102) that require temperature or humidity conditioned airflow. FIG. 3 is a perspective view similar to that of FIG. 1, with the payload (102) omitted to show only the pallet top (104), pallet base (106), and straps (108), while FIG. 4 shows a side elevation view of the same.

Figure 5:
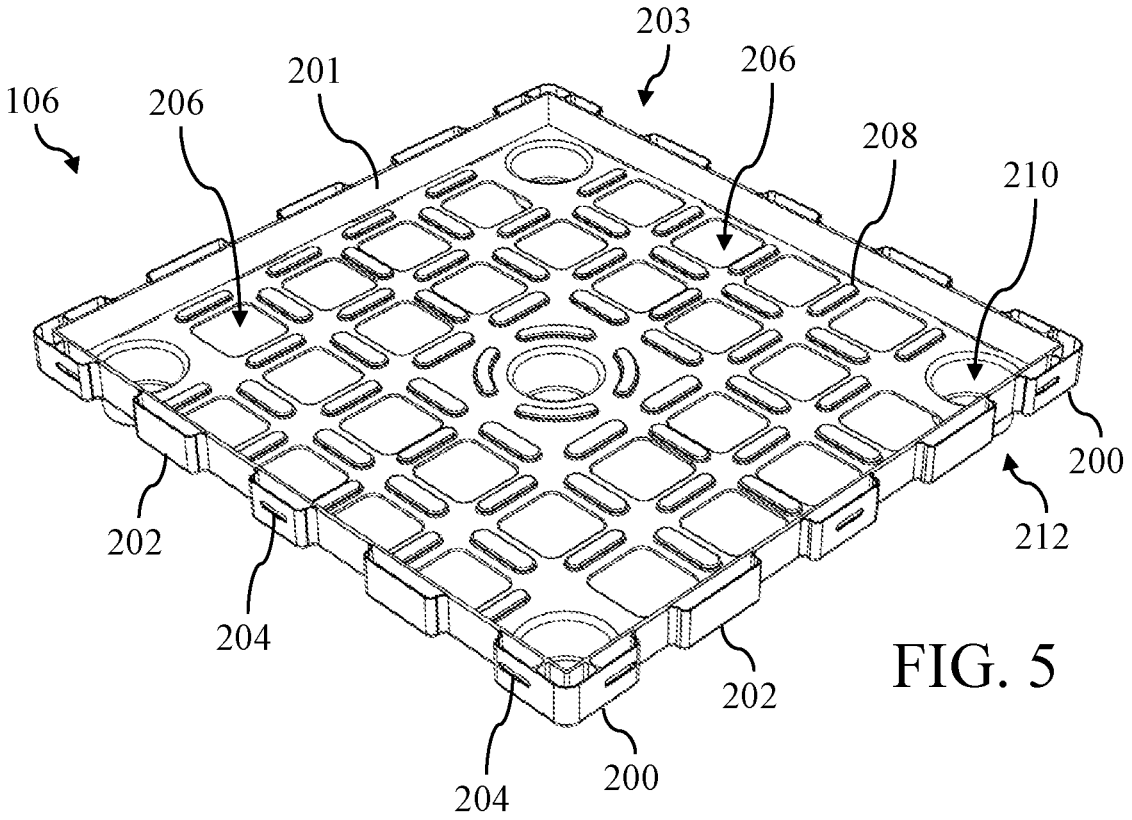
FIG. 5 is a perspective view of an exemplary pallet base.

FIG. 5 is a perspective view of a pallet base (106), which may be manufactured from plastics, resins, metals, or other materials. Desirable material characteristics include rigidity, durability, low mass, temperature resistance, and weather or water resistance, for example. The pallet base (106) may be formed (e.g., molded, printed) of a single plastic or other material in a unitary piece, or may be assembled (e.g., using mechanical connections, adhesives, heat fusion) from several separate pieces (e.g., in some cases the foot (112) may couple to the pallet base (106) by an adhesive or threaded connection, and may be formed of a separate or the same material). The pallet base (106) includes a cargo area (203) from which a rim (201) extends. The rim (201) height may be selected based upon the desired application of the pallet base, and in some implementations may be between about 0.5 inch and about 4 inches. The rim (201) height may be chosen to prevent cargo placed in the cargo area (203) from laterally sliding off the pallet base (106), while still allowing cargo to be easily placed within the cargo area (203).

A set of corner bumpers (200) and a set of side bumpers (202) are positioned around the rim (201). The bumpers (200, 202) may be formed of semi-rigid materials and may include a cavity between the bumper (200, 202) and the rim (201). The bumpers (200, 202) prevent the pallet base (106) and, when assembled, the payload (102) from resting flush against another surface (e.g., either a wall of a transport vehicle. Further, the bumpers (200, 202) provide protection against impact and crushing forces by flexing towards the rim (201) (e.g., into the cavity) when impinged by an outside force. As will be described in more detail below, the bumper (200, 202) cavities may also be filled with passive impact absorbers such as rubbers, foams, or springs in order to further protect the payload (102) from impacts or other forces against the pallet base (106) that holds it. The pallet base (106) includes four corner bumpers (200) and 12 side bumpers (202) distributed about the rim (201). The total number, rim (201) position and distribution, horizontal length, vertical height, and depth of the bumpers (200, 202) may be varied based upon a desired application.

Some or all of the bumpers (200, 202) may include a slot (204) passing from the exterior of the bumper (200, 202) into the cavity through which a portion or a clip of the strap (108) or another fixture may be passed. A plurality of openings (206) are distributed across the floor of the cargo area (203) to allow airflow from underneath the pallet base (106) to directly contact the payload (102). The plurality of openings (206) also reduce the material requirements and resulting weight of the pallet base (106). As an example, the size, number, shape, and locations of the openings (206) may be varied such that they account for between about 25% and about 60% of the area of the cargo area (203), which results in a corresponding decrease in weight as compared to a pallet base which does not include openings (206).

A plurality of spacers (208) are distributed across the floor of the cargo area (203). While the shape, position, and distribution may vary by implementation, FIG. 5 shows the spacers (208) as raised oblong structures positioned to surround each of the plurality of openings (206) (e.g., each opening may be adjacent to 2, 3, or 4 spacers (208) in the example of FIG. 5). When fully assembled, the payload (102) will rest upon the spacers (208). This allows airflow entering via the openings (206) to pass around and between the spacers (208) and contact a substantial portion of the underside of the payload (102) (e.g., in some implementations, between about 80% and about 95% of the underside area of the payload (102)). As will be apparent, the height of the spacers (208) may be varied as needed. As an example, in some implementations high airflow may be desirable and so the height of the spacers (208) and rim (201) may be increased to provide a larger volume of space between the pallet base (106) and the payload (102). In another example, the overall height of the assembled pallet may need to be minimized to accommodate a certain payload and/or transport vehicle, and the height of the spacers (208) may be reduced to accommodate, or the spacers (208) may be eliminated entirely.

As can be seen in FIG. 5, the foot (212) is hollow and projects from the underside of the pallet base (106) as a conical shape. A foot hollow (210) of each foot (212) is open from the cargo area (203). The foot hollow (210) may remain hollow during use of the pallet base (106) in order to reduce weight, or in some cases may include passive (e.g., rubbers, foams, springs) or active (e.g., mechanical shock absorbers) shock and impact mitigation materials or devices. In some implementations, as will be described in more detail below, the foot hollow (210) may receive a transport module that includes sensors, tracking features, and other features useful during transport of goods.

Figure 6:
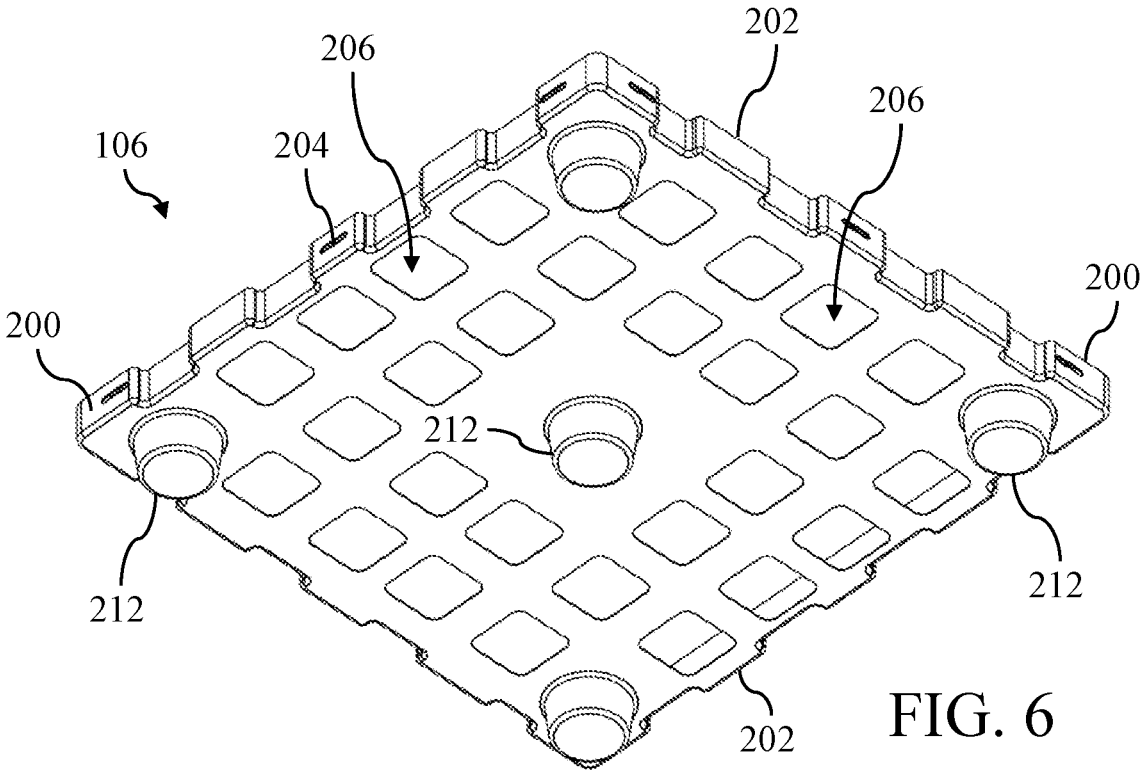
FIG. 6 is a bottom perspective view of the pallet base of FIG. 5.

FIG. 6 shows the pallet base (106) from below, where the plurality of openings (206) are shown to pass through into the cargo area (203). From below, a set of five feet (212) can be seen with a single foot (212) at each corner, and the final foot (212) positioned at the approximate center of the pallet base (106). From below, the bumpers (200, 202) can be seen to be closed from below, such that the cavity between the rim (201) is only accessible from above the pallet base (106). In some implementations, the bumpers (200, 202) may be open only from below, or may be open from both sides.

Figure 7:
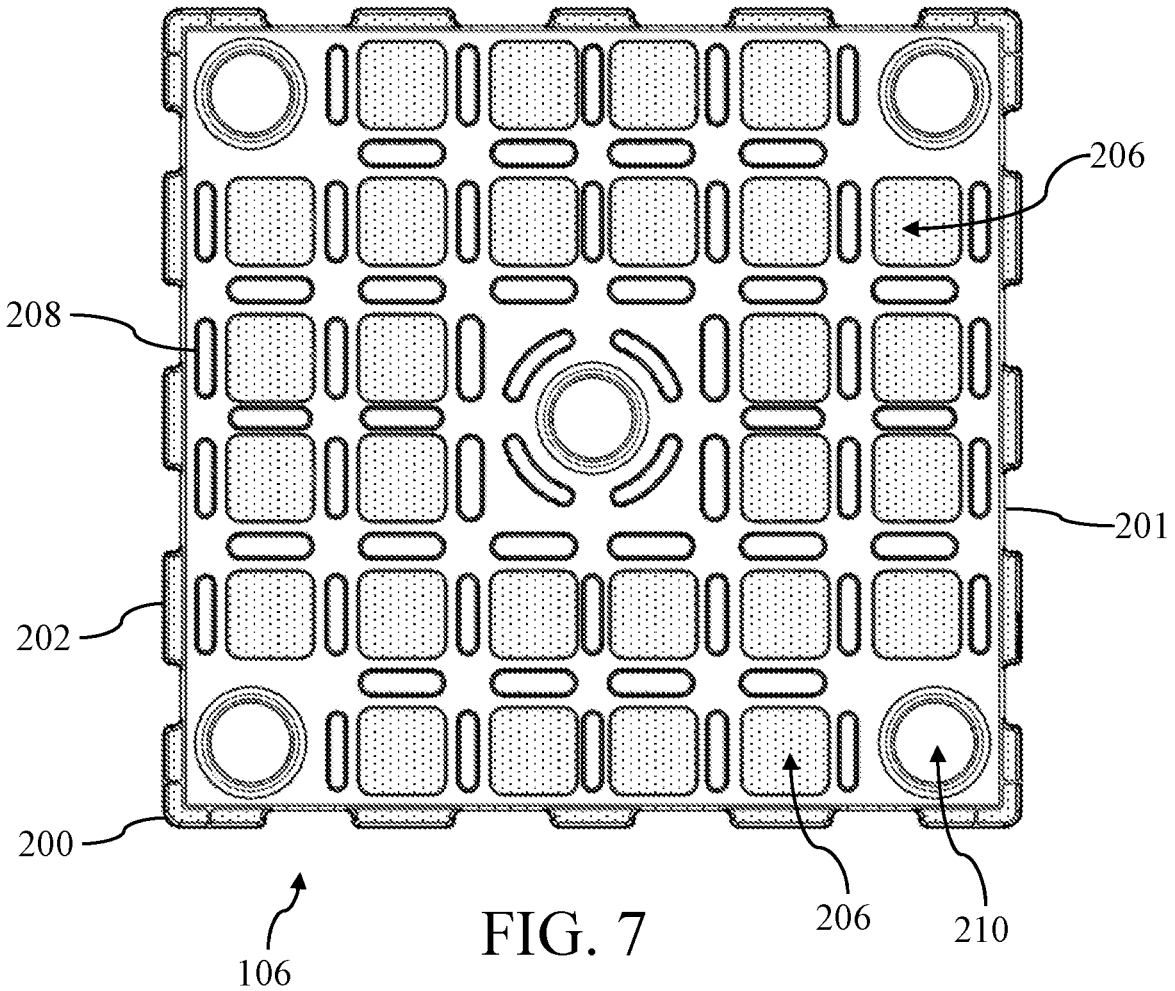
FIG. 7 is a top-down view of the pallet base of FIG. 5.
Figure 8:
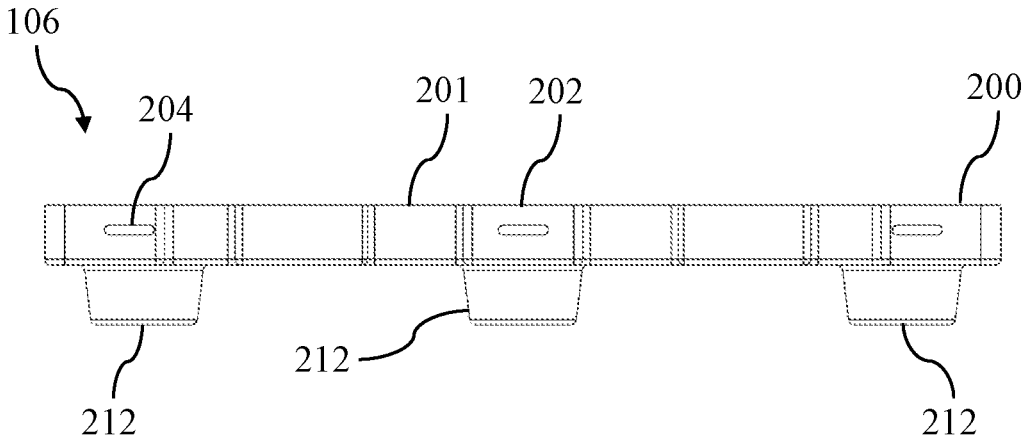
FIG. 8 is a side elevation view of the pallet base of FIG. 5.

FIG. 7 shows a top down view of the pallet base (106), with areas that are openings or hollows (e.g., such as the openings (206) and the cavities of the bumpers (200, 202) shown with a dotted pattern to distinguish them from areas of solid material (e.g., such as the interior of the feet (212), or the surface of the spacers (208)). FIG. 8 shows a side elevation view of the pallet base (106), where it can be seen that the feet (212) account for approximately half of the overall height of the pallet base (106), with the cargo area (203) and the rim (201) accounting for the remainder. It should be understood that the height of the feet (212) and the rim (201) may be varied for particular applications, and so in some implementations the height of the feet (212) may account for between about 15% and about 75% of the overall height of the pallet base (106).

As an example, where a particular transport vehicle has an assembled pallet height limit of 72 inches and a particular payload has a height of 68 inches prior to assembly, the additional height added during assembly (e.g., by a wooden pallet, or by the pallet base (106)) becomes critical. In such cases, a specialized pallet base (106) may be provided such that the height of the feet (212) plus the thickness of the floor of the cargo area (203) is less than four inches (e.g., cargo area (203) thickness of 0.5 inch and foot (212) height of 3 inches), allowing the assembled pallet to fit within the 72 inch limit. Conventional wooden pallet heights vary between 5-6 inches in height, and are difficult to flexibly produce at reduced heights to the structural limitations on wood materials, and so would be unsuitable for the above example.

Figure 9:
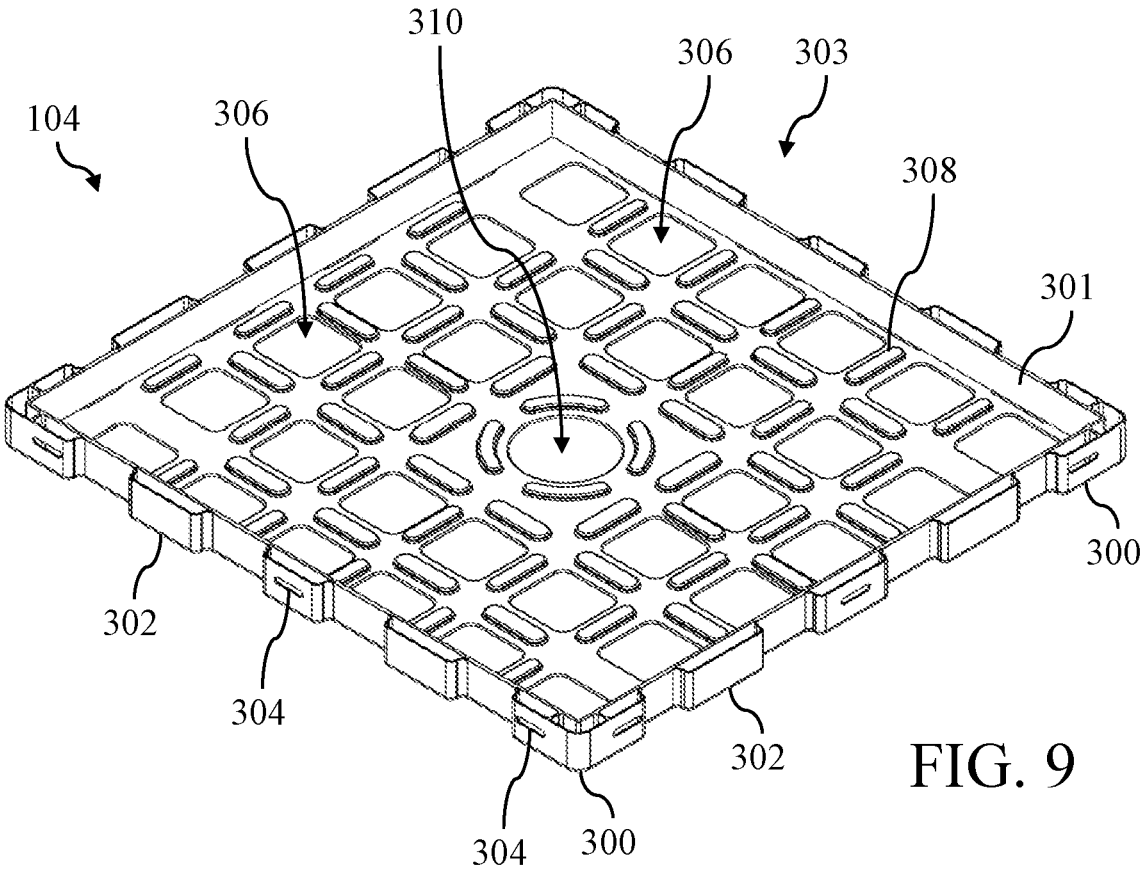
FIG. 9 is a perspective view of an underside of an exemplary pallet top.
Figure 10:
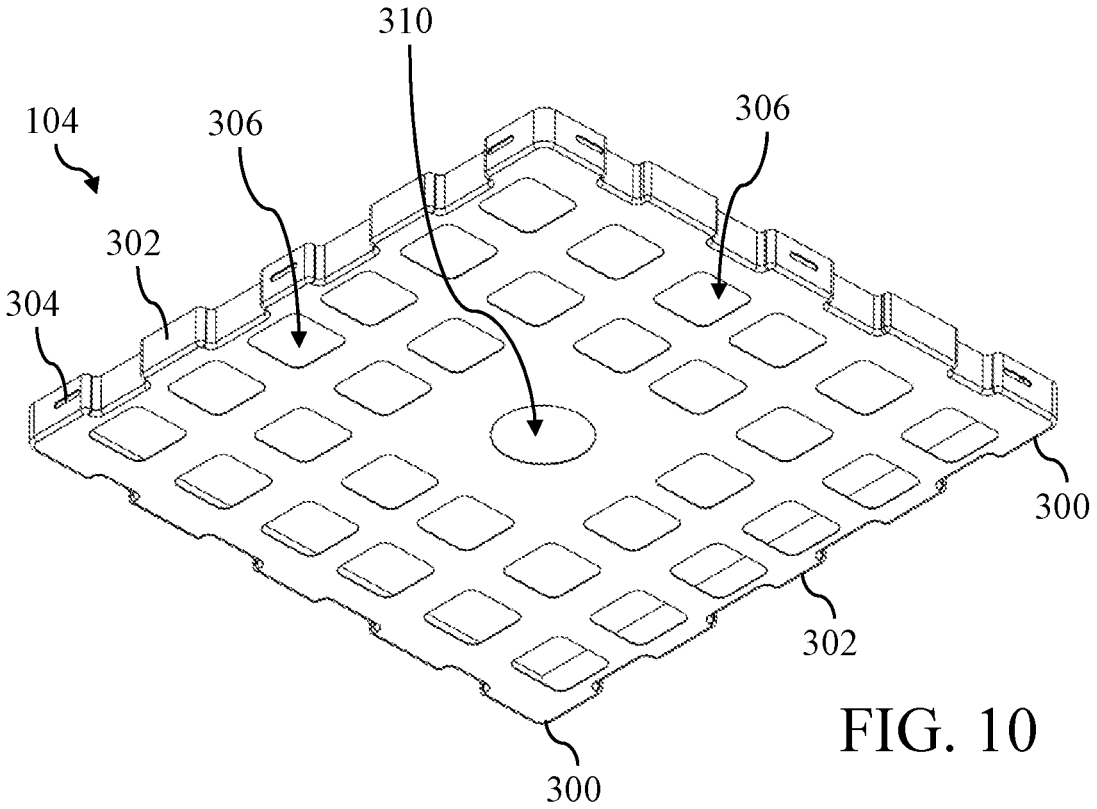
FIG. 10 is a perspective view of a top side of the pallet top of FIG. 9.
Figure 11:
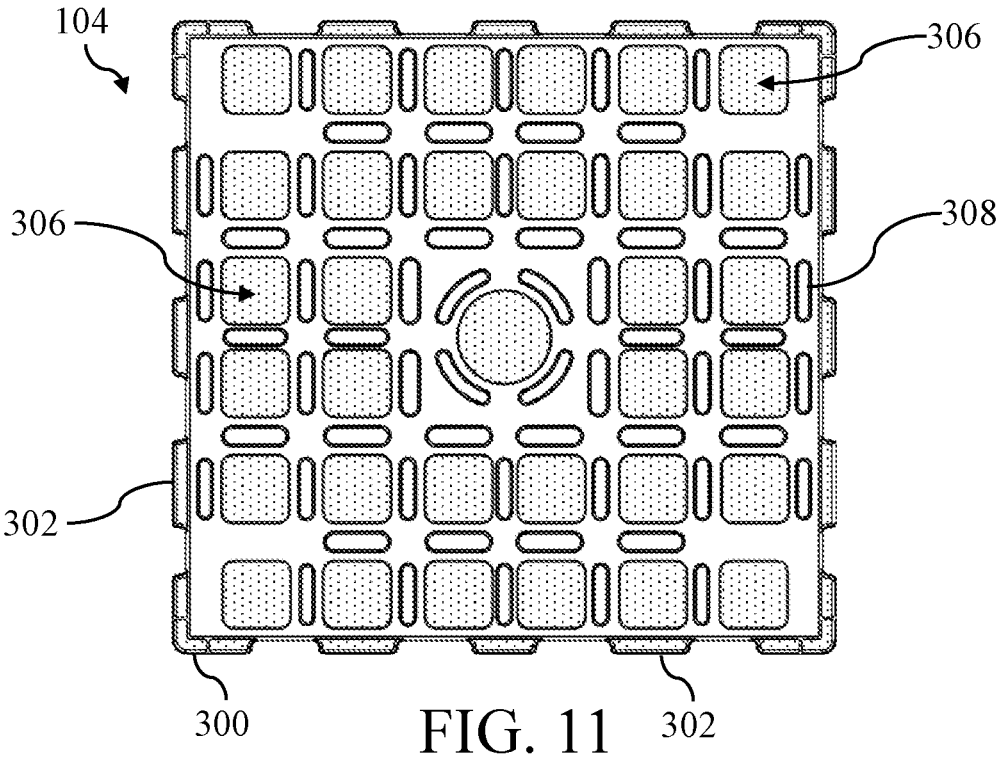
FIG. 11 is a top-down view of the pallet top of FIG. 9.

FIG. 9 is a perspective view of an underside of the pallet top (104). The pallet top (104) shares some similar features with the pallet base (106), such as a rim (301) that surrounds a cargo area (303), corner bumpers (300) and side bumpers (302) that may include slots (304) corresponding to the slots (204) on the pallet base (106), a plurality of openings (306, 310) that pass through the ceiling of the cargo area (303) to allow airflow, and a plurality of spacers (308) distributed across the ceiling of the cargo area (303) to allow airflow across the top of the payload (102). FIG. 10 shows the pallet top (104) from a top side, while FIG. 11 shows a top-down view of underside of the pallet top (104). As with the pallet base (106), the size, number, shape, and locations of the openings (306) may be varied such that they account for between about 25% and about 80% of the area of the cargo area (303), which results in a corresponding decrease in weight as compared to a pallet top which does not include openings (306).

Figure 12A:
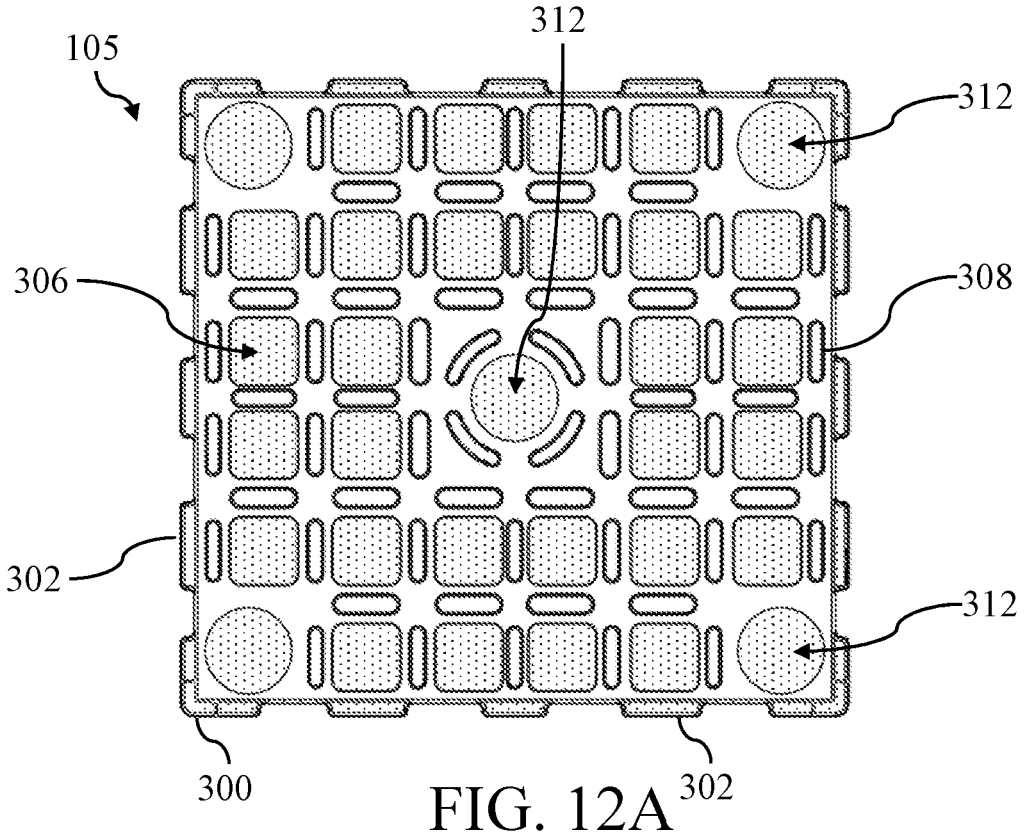
FIG. 12A is a top-down view of an alternate exemplary pallet top.
Figure 12B:
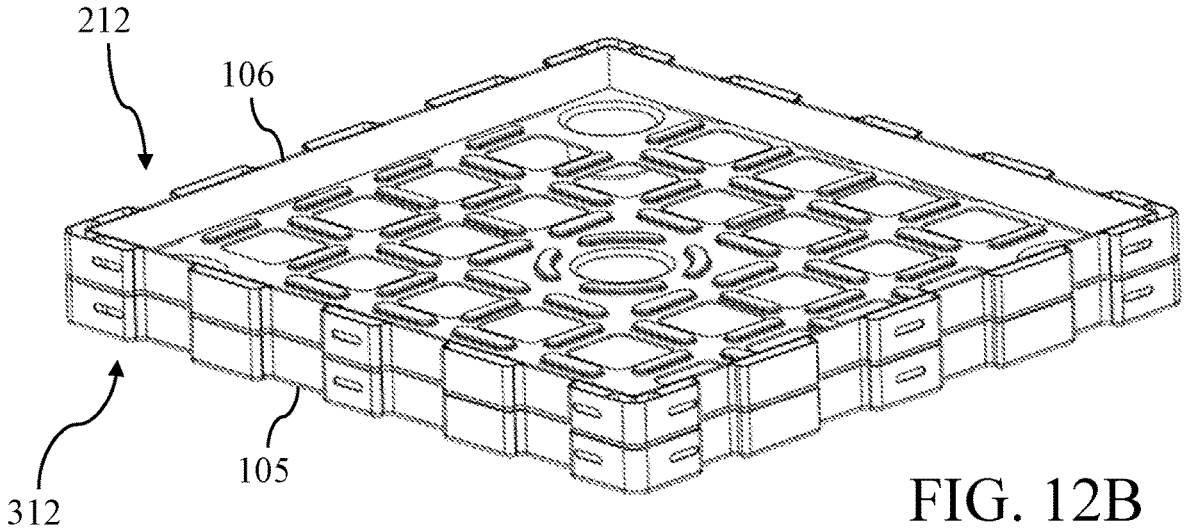
FIG. 12B is a perspective view of the pallet top of FIG. 12A nested with the pallet base of FIG. 5.

FIG. 12A is a top-down view of an alternate pallet top (105) for which several of the openings (306) are replaced by a foot receiver (312), each of which is associated with a corresponding foot (212) of the pallet base (106). In other words, the number, the size, shape, and position of the foot receivers (312) in the pallet top (105) correspond to the number, size, shape and position of the feet (212) in the pallet base (106), such that the pallet base (106) and pallet top (105) may be nested together when not in use, and may facilitate stacking of two or more assembled pallets (100) when in use. To illustrate, FIG. 12B shows a perspective view of the pallet top (105) nested with the pallet base (106). The pallet base (106) may be placed into the cargo area (303) of the pallet top (105) with the feet (212) leading. Each of the feet (212) will be received by and at least partially nest within the corresponding foot receiver (312) of the pallet top (105). The nested assembly may then be fixed together with straps or other couplings (e.g., passed through the slots (204, 304), the openings (206, 306)). In a nested form, the pallet base (106) and pallet top (105) may be easily stored or transported.

The size and characteristics of the foot receivers (312) may be varied to reduce overall height of the nested assembly (e.g., such as by reducing the diameter of an open foot receiver (312) to allow more of the foot (212) to pass through), or to provide a cavity within the nested area that may be used to store palletizing components that will be later used (e.g., such as the straps (108), rain covers, thermal covers, or other items that might be used to assemble the assembled pallet (100)). In some implementations, the foot receivers (312) may instead be closed and may provide an impression that the corresponding foot (212) rests within but does not pass through. This may be advantageous for stacking two or more assembled pallets (100), as an assembled pallet (100) stacked on top of another will resist shifting or sliding when its feet (212) rest within indentations of the corresponding foot receivers (312) on the pallet top (105) of the assembled pallet (100) below.

Figure 12C:
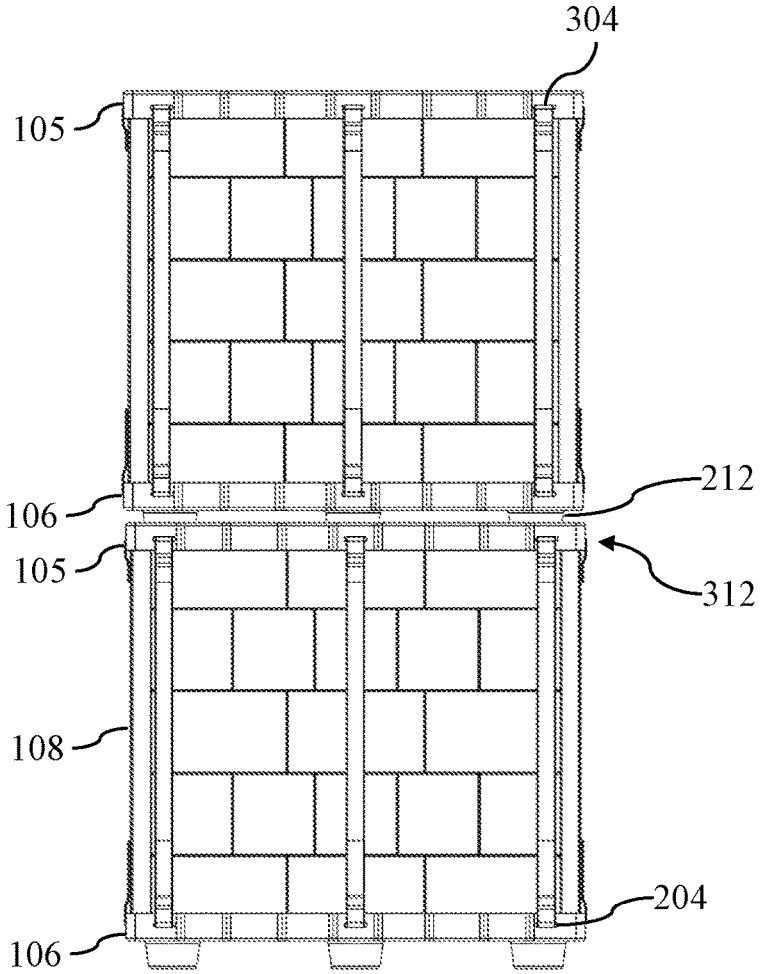
FIG. 12C is a side elevation view of two stacked assembled pallets using the pallet top of FIG. 12A.

FIG. 12C shows an example of two assembled pallets (100) stacked, with the feet (212) of the upper pallet base (106) resting within the foot receivers (312) of the lower pallet top (105). In such an example, the straps (108) may span the height of a single assembled pallet (100) as illustrated, or may span the height of both assembled pallets to create a more stable assembly (e.g., the strap (108) may connect to the slot (204) in the lower pallet base (106) at a first end, and may connect to the slot (304) in the upper pallet top (105) at a second end).

Figure 13A:
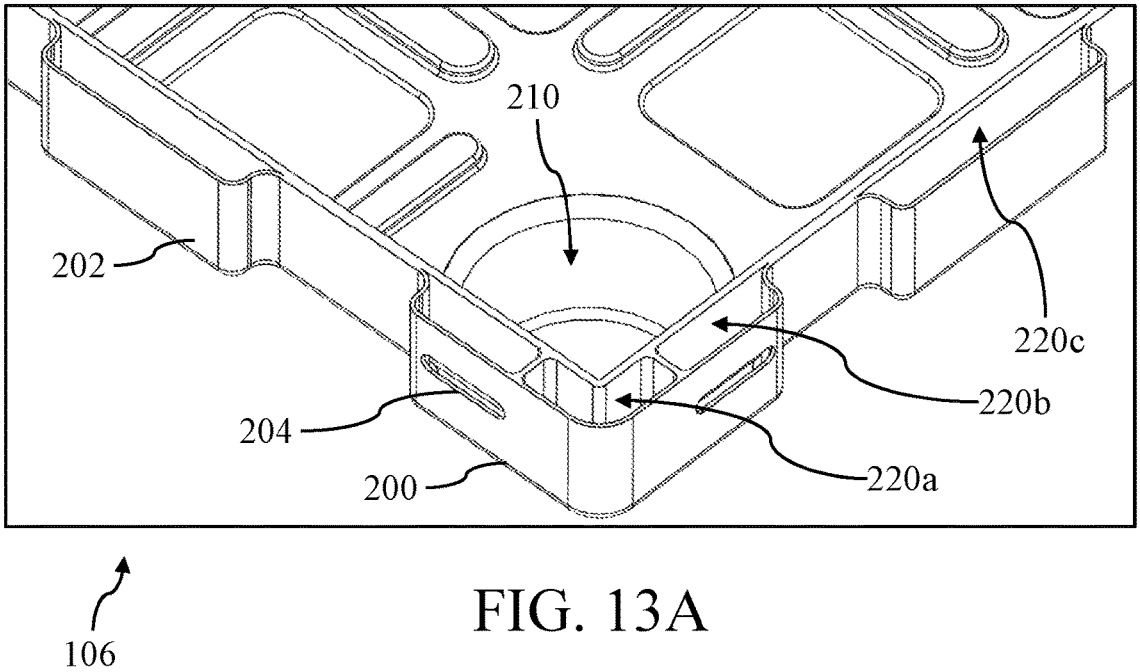
FIG. 13A is a perspective view of a corner of the pallet base of FIG. 5.

FIG. 13A is a perspective view of a corner of the pallet base (106). From this magnified perspective, a set of cavities (220*a*, 220*b*, 220*c*) are visible within the corner bumper (200) and the side bumper (202). As has been described, the cavities may remain hollow in order to reduce assembled weight and provide some mitigation of impact forces against the pallet base (106), or may be filled with shock absorbing materials or devices to provide further mitigation. One or more of the cavities (220*a*, 220*b*, 220*c*) may also be used to hold a transport module, which may be an electronic device including sensors, trackers, and devices that are useful when transporting goods. The foot hollow (210) may similarly remain empty to reduce weight, or may be filled with shock absorbing materials or devices, or transport modules.

Figure 13B:
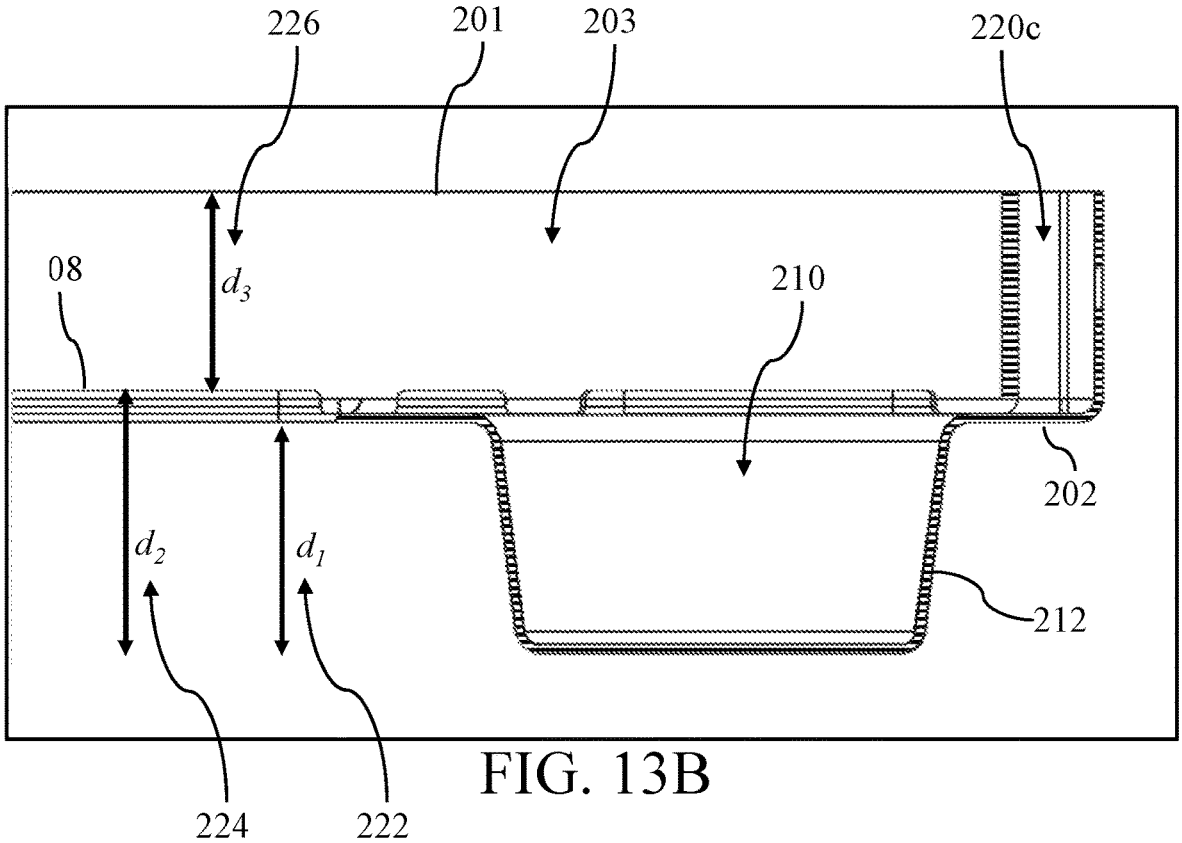
FIG. 13B is a cross sectional view of an edge of the pallet base of FIG. 5.

FIG. 13B shows a cross sectional view of the pallet base (106), where the foot hollow (210) and the cavity (220*c*) can be clearly seen. That figure also illustrates the flexibility in implementing the pallet base (106) with varying heights of the rim (201), spacers (208), and feet (212). A first distance (222) $d_1$ illustrates the distance between a surface upon which the foot (212) would rest and the underside of the pallet base (106), while a second distance (224) $d_2$ illustrates the distance between the surface and the interior of the cargo area (203) upon which the payload (102) would rest. While the thickness of the floor of the cargo area (203) itself cannot be arbitrarily reduced while maintaining structural integrity and rigidity of the pallet base (106) as a whole, the first distance (222) and the second distance (224) may be varied in order to provide a desired level of airflow, a desired level of floor surface clearance, or a desired overall height of the assembled pallet (100).

For example, where the assembled pallet (100) height will exceed a limitation on height, the first distance (100) may be reduced by reducing the foot (212) height. Where increased airflow is desired on the underside of the payload, the height of the spacers (208) (e.g., the difference between the second distance (224) and the first distance (222) may be increased. A third distance (226) $d_3$ illustrates the height of the rim (201), which itself may be reduced or increased depending upon a particular application. For applications that include increased airflow (e.g., by increasing spacer height as described above), the third distance (226) may be correspondingly increased to prevent shifting or sliding of the payload (102) from the cargo area (203). While each of FIGS. 13A and 13B show features of the pallet base (106), it should be understood that some or all of those features are shared with the similar structures of the pallet top (104) (e.g., such as the cavities (220*a*, 220*b*, 220*c*)).

Figure 14A:
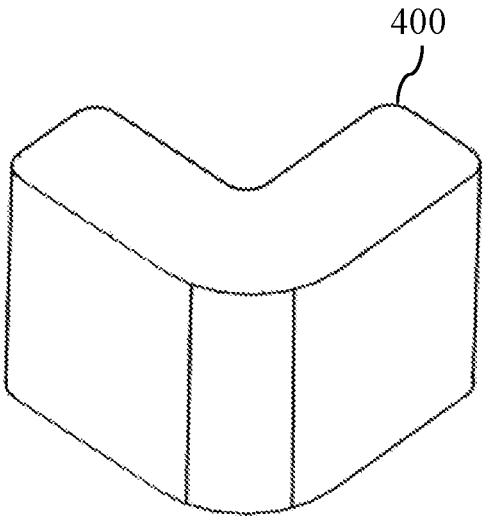
FIG. 14A is a perspective view of an exemplary sensor module usable with the pallet base of FIG. 5.
Figure 14B:
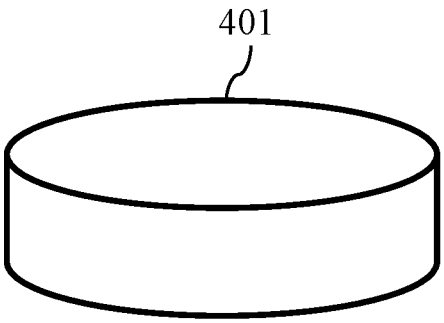
FIG. 14B is a perspective view of an alternate exemplary sensor module usable with the pallet base of FIG. 5.
Figure 15:
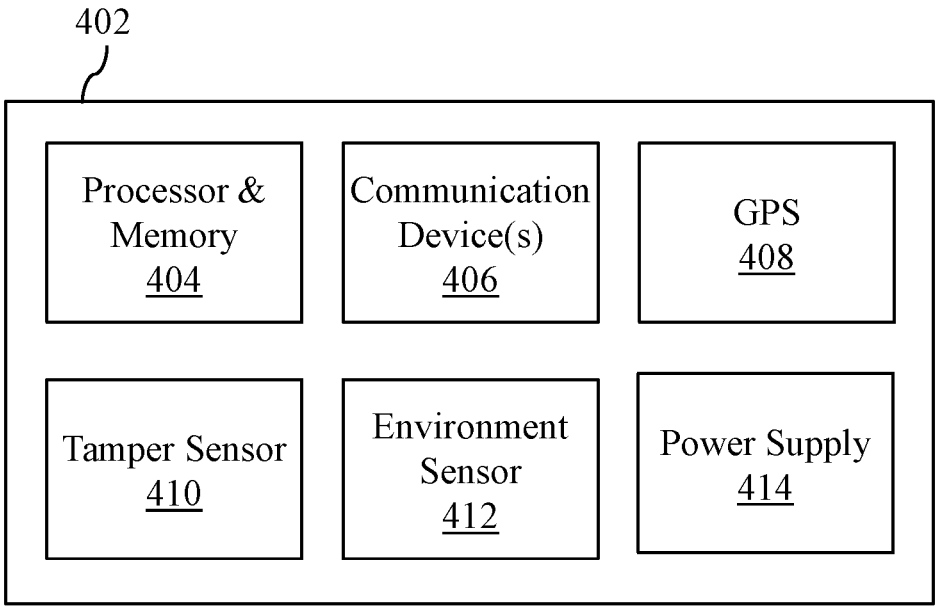
FIG. 15 is a schematic diagram of the sensor module of FIG. 14A or 14B.

FIGS. 14A and 14B show perspective views of exemplary sensor modules, while FIG. 15 shows a schematic diagram of a sensor module. In FIG. 14A, a sensor module (400) is shaped to fit within the cavity (220*a*) of the corner bumper (200) of the pallet base (106) or the corner bumper (300) of the pallet top (104). In FIG. 14B, a sensor module (401) is shaped to fit within the foot hollow (210) of the pallet base (106). Sensor modules may take other shapes that are complementary to structures of the assembled pallet (100) and, for example, may be shaped to fit within the cargo area (203) below the level of the spacers (208), on the rim (201, 301) in the gaps between bumpers (200, 202, 300, 302), or on the underside of the pallet base (106) in the air gap provided by the feet (212).

FIG. 15 shows a sensor module (402) in schematic form, and may be representative of some or all of the features contained by other sensor modules (400, 401). The sensor module (402) includes a processor and memory (404) that are operable to execute software instructions to receive, send, analyze, and modify data, and to operate the various other components of the sensor module (402). One or more communication devices (406) may be included, such as transceivers capable of communicating via cellular signals, Wi-Fi signals, Bluetooth signals, or other short- or long-range wireless signals, as well as USB connections or other wired data connections. A GPS receiver (408) is capable of determining a current location of the sensor module (402) and providing that information the processor and memory (404) or another device in order to aid in tracking the sensor module (402), as well as any assembled pallet (100) it is coupled to.

A tamper sensor (410) may include one or more sensors or devices configured to detect tampering with the assembled pallet (100), and to provide audible or visible alarms, electronic notifications, or both. In some implementations, a tamper sensor (410) includes a motion or vibration detection sensor that detects when cargo that should be motionless is being moved. In some implementations, a tamper sensor (410) includes a short-range wireless transceiver in the pallet base (106) that is communicatively coupled with a corresponding short-range wireless transceiver in a separate sensor module (402) in the pallet top (104).

In such an implementation, the transceivers would be configured to detect their relative distance from each other after the assembled pallet (100) is complete, and would raise an alarm when that distance changed (e.g., such as might happen if someone were to remove the pallet top (104) from the assembled pallet (100).

In some implementations, a tamper sensor (410) includes a pressure sensor that detects the compression of the assembled pallet (100) by the straps (108) and raises an alarm when that pressure changes indicating that the straps (108) have been loosened or removed. Such a pressure sensor might be in a cargo area (203, 303) and positioned so that the payload (102) presses against it as it is compressed, or may be positioned at one or more of the slots (204, 304) so that the strap (108) presses against it when in place.

One or more environment sensors (412) may be included to track general information relating to the environment that the assembled pallet (100) is in throughout its shipment. Environment sensors (412) may include temperature sensors, humidity sensors, shock and impact sensors, vibration sensors, tilt sensors, and other sensors. Information from various sensors (e.g., the GPS (408), tamper sensors (410), environment sensors (412)) may be logged along a timeline throughout shipment of the assembled pallet in order to create a timeline of events that may have impacted the safety or security of the assembled pallet (100).

A power supply (414) such as a battery may also be included in the sensor module (402), and may be configured to power all other components of the module. The power supply (414) may be replaceable or rechargeable. One or more sensor modules (402) may be placed with each assembled pallet (100) (e.g., one module coupled to pallet base (106) and one module coupled to the pallet top (104)), and may be readily have their power supplies (414) replaced or recharged between uses or during transit as may be needed.

Figure 16A:
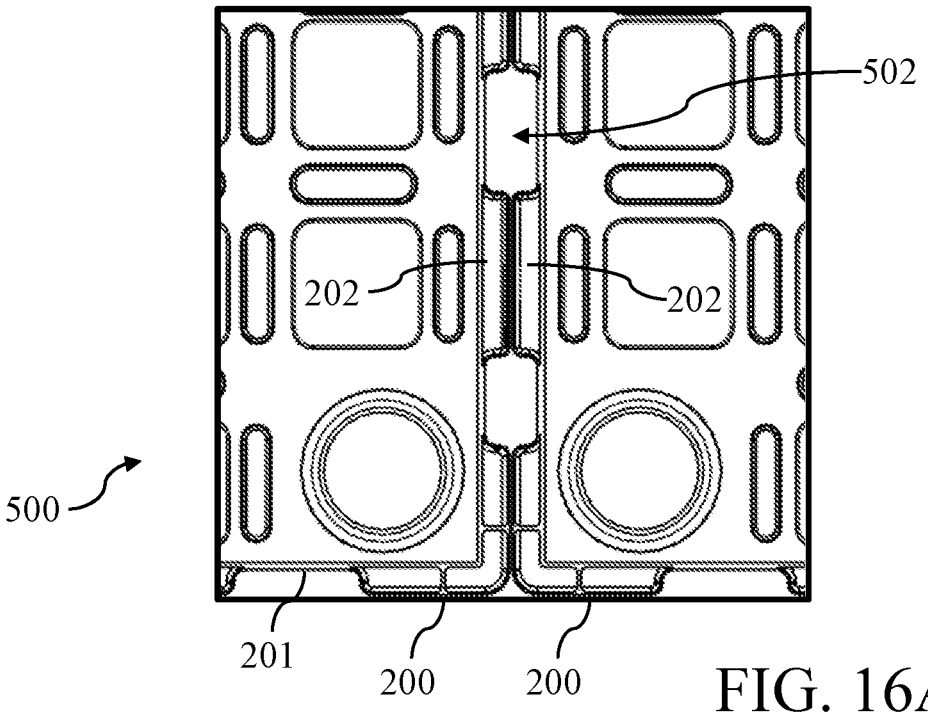
FIG. 16A is a top down view of the edges of two pallet bases arranged to allow airflow.

FIG. 16A shows a top down view of the edges of two pallet bases (106) arranged so that the bumpers (200, 202) meet and allow airflow between. As has been described, it may be advantageous for some payloads (102) to allow climate-controlled air to readily flow below, around, and above the payload (102) during shipment. In such a spaced arrangement (500), the corner bumpers (200) and side bumpers (202) of two adjacent pallet bases (106) will meet when the bases are pushed together, and provide a set of gaps (502) through which air can flow. Further, since the payload (102) will typically be confined within the rim (201), there will also be a gap along the entire height of the payload (102) through which air can flow from the gaps (502).

Figure 16B:
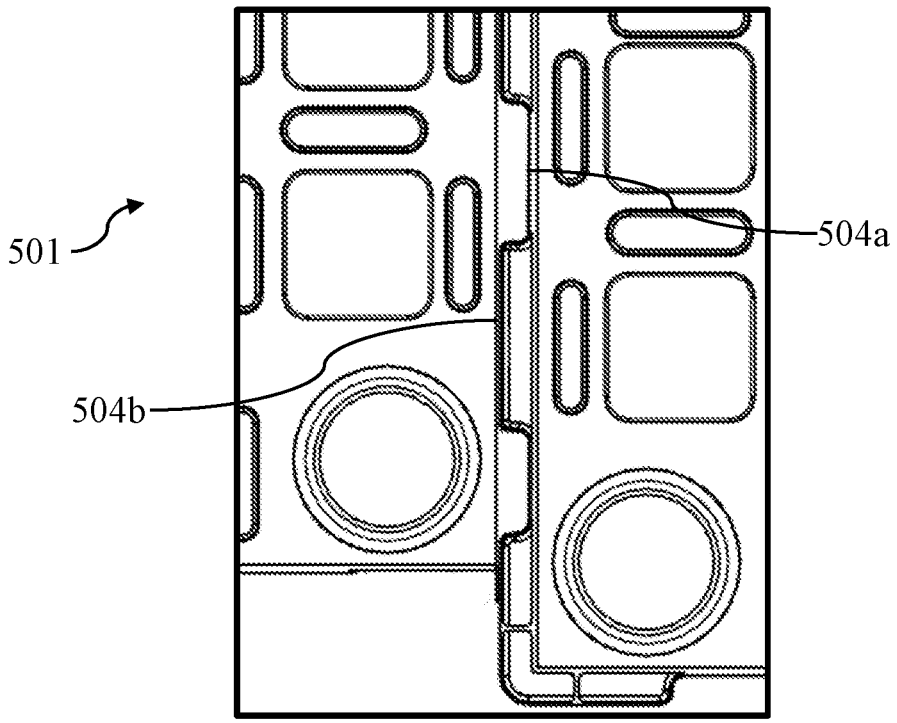
FIG. 16B is a top down view of the edges of two pallet bases arranged to minimize shifting.

Alternately, where an arrangement of assembled pallets (100) should maximize use of space rather than airflow, a nested arrangement (501) may be used as shown in FIG. 16B. In such an arrangement (501), two or more different types of pallet bases (106) may be used that have complementary sets of bumpers (504*a*, 504*b*) that nest within each other instead of meeting and forming gaps (502). In this manner, a first bumper (504*a*) may be offset from a second bumper (504*b*) such that each bumper is received by a gap adjacent to the opposing bumper. The result is a tight nesting of each assembled pallet (100) to one or more adjacent pallets, which may efficiently use space within a transport vehicle and can also prevent shifting of pallets since each pallet is physically engaged to each adjacent pallet in a way that prevents shifting or sliding in at least one direction.

Figure 17A:
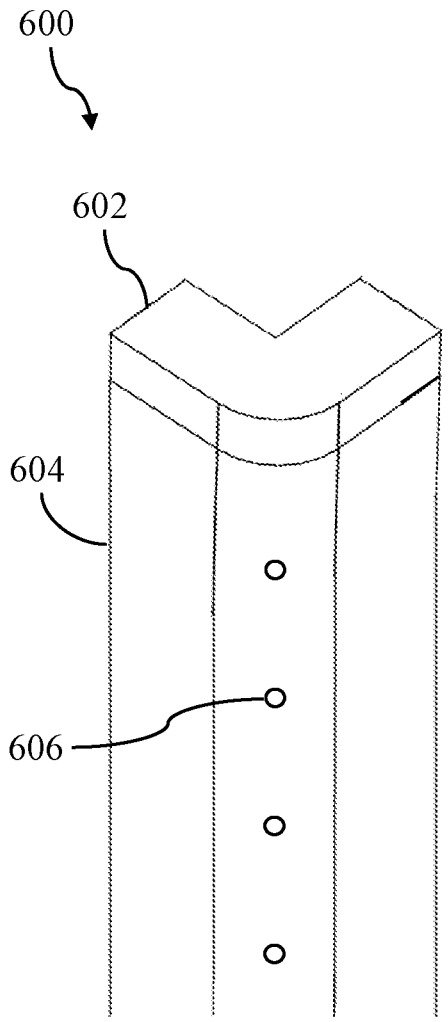
FIG. 17A is a perspective view of an exemplary adjustable corner guard.
Figure 17B:
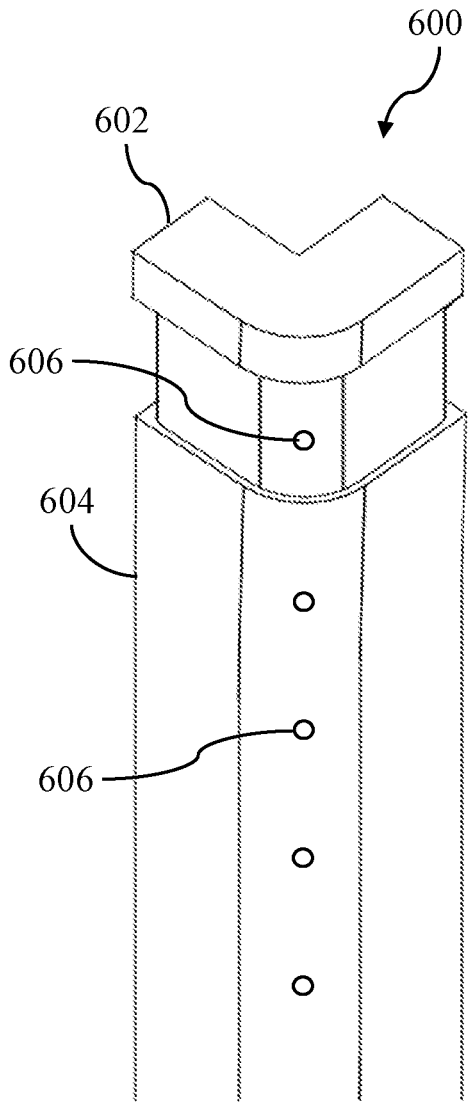
FIG. 17B is a perspective view of the adjustable corner guard of FIG. 17A in an extended state.

FIGS. 17A and 17B each show perspective views of an adjustable corner guard (600) that may be used with the pallet base (106) and pallet top (104). As can be seen, the overall profile of the adjustable corner guard (600) matches the cavity (220*a*) of the corner bumpers (200, 300), such that a first end may be inserted into the corner bumper (200) of the pallet base (106) and a second end may be inserted into the corner bumper (300) of the pallet top (104). When in place, the corner guards may protect the payload along the entire height of the assembled pallet, such that an impinging force or object that is positioned above the lower corner bumper (200) but above the upper corner bumper (300) may still be deflected by the corner guard (600) and prevent damage to the payload (200). While shown in a form that fits the cavity (220*a*) of the corner bumpers (200, 300), it should also be understood that adjustable corner guards could be provided for the side bumpers (202, 204) with some adjustments to their shape and profile.

The adjustable guard (600) includes an outer shaft (604) with a hollow interior in which an inner shaft (602) is slideably inserted. A set of fixture points (606) are positioned along the outer shaft (604) and the inner shaft (602) and may receive a bolt or other connector to fix the two shafts together at a desired length. The guard (600) is shown in FIG. 17A at a minimum length, while FIG. 17B shows the guard (600) at an extended length with the inner shaft (602) extending from the interior of the outer shaft (604). In use, this allows the guard (600) to be extended to a desired height once the height of the payload (102) is determined. Implementations having the set of fixture points (606) may allow for a number of different height adjustments (e.g., at set intervals between the minimum length and the maximum length, which may be about twice the minimum length). In some implementations, the guard (600) may instead use a screw-tension style fastener that provides for nearly unlimited variability in guard height.

Figure 18A:
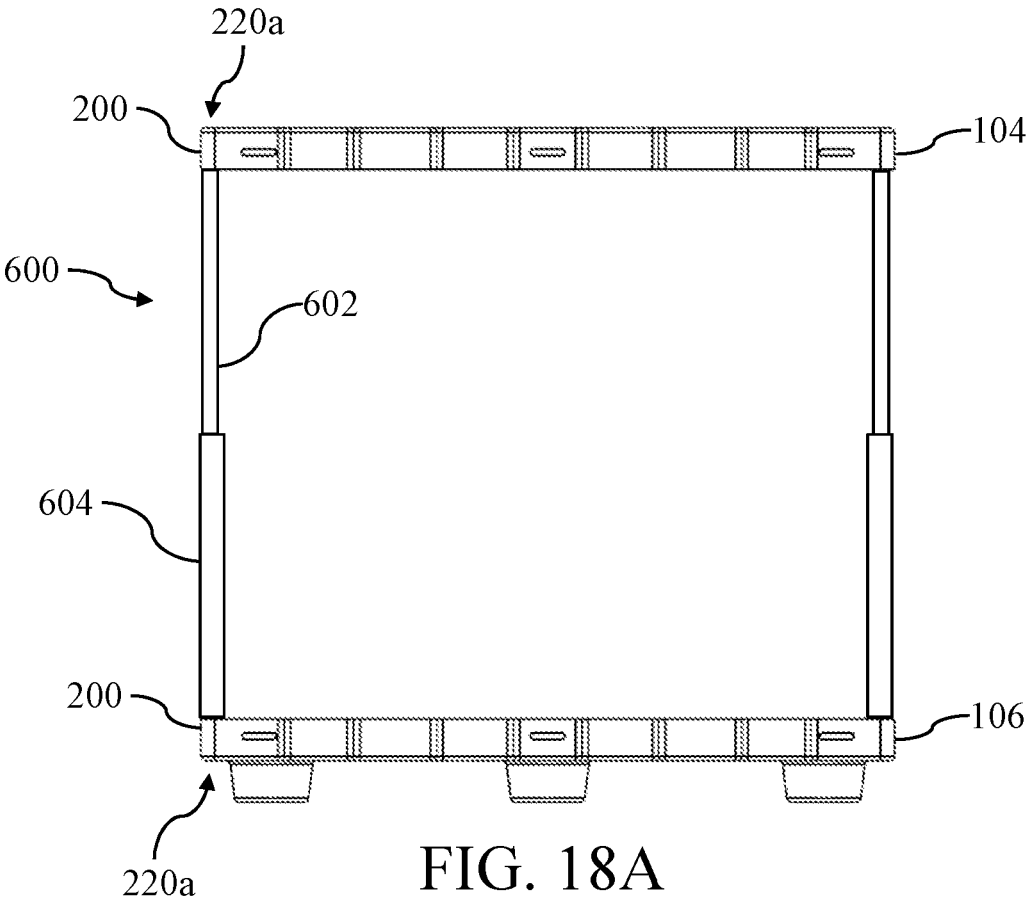
FIG. 18A is a side elevation view of the adjustable corner guard of FIG. 17A coupling a pallet base and a pallet top at a first height.
Figure 18B:
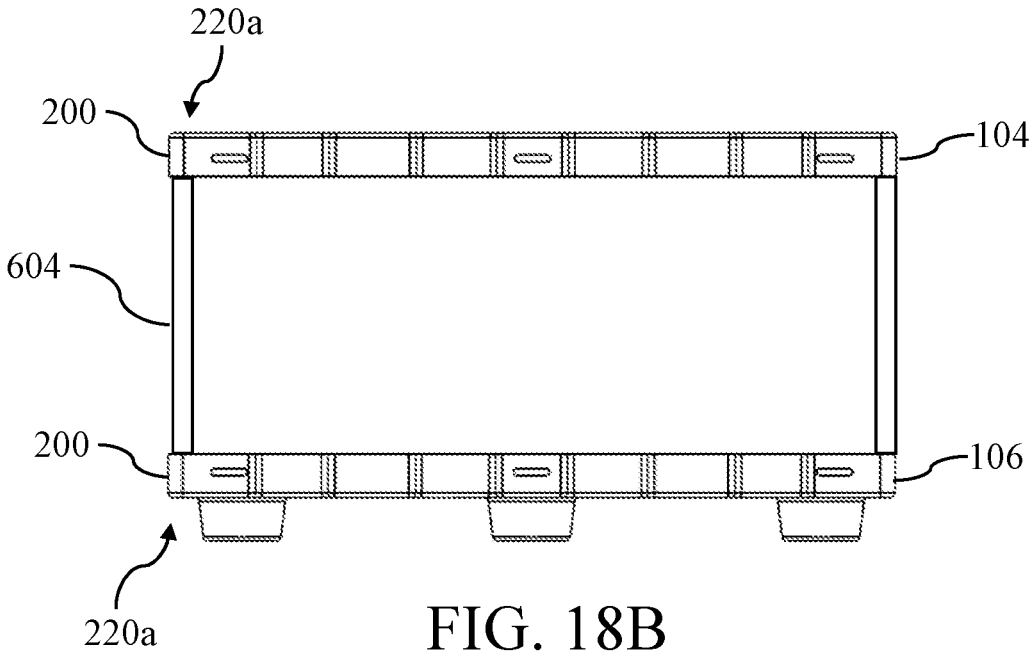
FIG. 18B is a side elevation view of the adjustable corner guard of FIG. 17A coupling a pallet base and a pallet top at a second height.

FIGS. 18A and 18B show examples of assembled pallets (100) using adjustable guards (600). In FIG. 18A, the guard (600) has been extended to near its maximum length with most of the inner shaft (602) exposed from the outer shaft (604). An upper end of the guard (600) is within the crevice (220*a*) of the upper corner guard (200) and the lower end of the guard (600) is within the crevice (220*a*) of the lower corner guard (200). In FIG. 18B, the guard (600) has been reduced to its minimum length with only the outer shaft (604) visible, and the inner shaft (602) entirely contained within. In addition to providing additional corner protection, or, in the case of adjustable side guards, additional edge protection, use of adjustable guards provides additional stability and connecting structure between the pallet base (106) and the pallet top (104). The adjustable guards may be used with straps (108), or in some implementations, may be used to both provide protection and compress the assembled pallet (100). As an example, each guard may include a threaded connector hole at each end such that a bolt or screw may be threaded through the bumper (200, 202) and into the guard to create a rigid coupling.

The disclosed system may also support other modular features and components. As an example, some implementations of the assembled pallet (100) may include rubber or foam impact dampening inserts placed in the cargo areas (203, 303) between the payload (102) and the pallet top (104) and/or pallet base (106). These foam inserts may be of variable thickness and density, and may be formed into a grid pattern that does not prevent airflow through the openings (206, 306). As another example, some implementations the feet (112) may include foams, rubbers, friction materials, or other materials or coatings that may help absorb shocks or vibrations and prevent them from traveling through the feet (112) and pallet base (106) to the payload (102), or may prevent the pallet base (106) from readily sliding when placed on a surface.

In some implementations, cargo nets and weather resistant covers may be used with the assembled pallet (100) and may use the slots (204, 304) as connection points. Cargo nets provide extra stability to the payload (102), while weather resistant covers may be waterproof and thermal resistant in order to prevent ambient temperatures from influencing the payload, and to hold the payload (102) at its starting temperature (e.g., in some cases the payload (102) and/or thermal materials such as ice or artificial phase change materials may be cooled to a very low temperature and included in the assembled pallet (100) in order to help maintain a desired shipping temperature). In some implementations, covers may also be selected or manufactured to provide fire resistance, additional protection for electronics (e.g., magnetic or electromagnetic shielding to prevent accidental damage or reduce risk of electronic scanning or interference with internal components), additional protection against biological contamination (e.g., mold resistance, antimicrobial surfaces or treatments), and other features.

Cargo nets and weather covers may connect directly to the slots (204, 304), or may connect to a ring or slot connector present on the straps (108), or vice versa. For example, in some implementations, the fully assembled pallet (100) as seen in FIG. 1 may be fitted with a weather cover that covers the pallet top (104) and connects to ring connectors on the straps (108) near the pallet base (106). In other implementations, a cargo net may connect to the slots (204) of the pallet base (106) and wrap the entire payload prior to the pallet top (104) being added. In such a case, the cargo net may provide rings or slots near the pallet base (106) that the straps (108) may connect to when the pallet top (104) is added.

Any of the modular cargo components discussed above may be combined as needed for a particular application or payload. For example, FIGS. 19A-19E show additional examples of palletized loads using combinations of the materials and features disclosed above. FIG. 19 shows a protective tray (700) that may be positioned between the payload (102) and the pallet base (106) during assembly of a pallet. The protective tray (700) may be waterproof, fire resistant, thermally insulated, or otherwise protective, and may be made of rigid materials where desired. Various implementations of the protective tray (700) may provide additional protection from water or debris coming from below the pallet base (106), may help maintain the state of phase change materials within the payload (102) (e.g., by covering the plurality of openings (206) when additional airflow around the payload (102) is not desirable), may protect the payload (102) from smoke or fire, or may provide other types of protection.

Figure 19A:
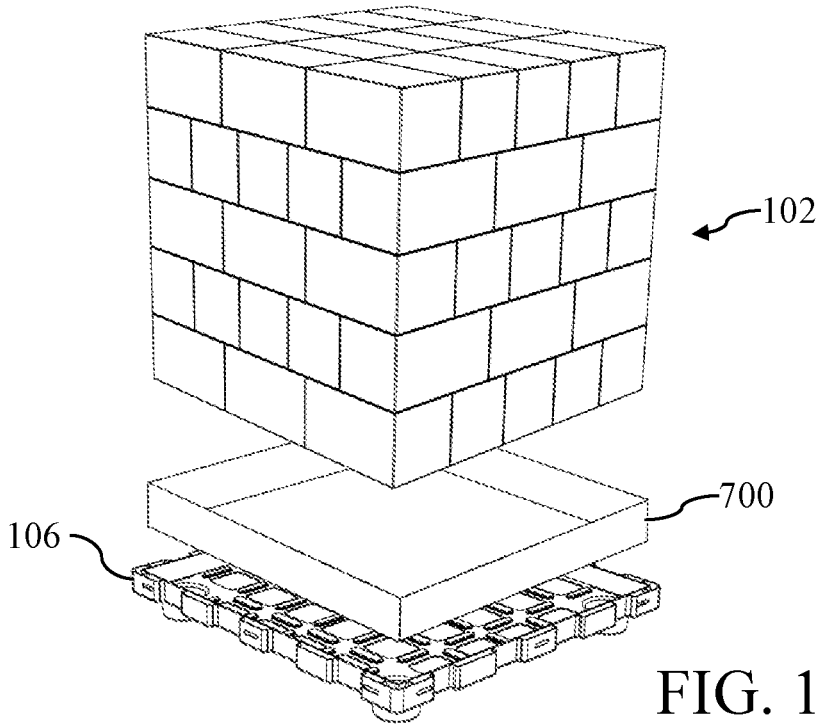
FIG. 19A shows an exemplary protective tray in use with a palletized load.
Figure 19B:
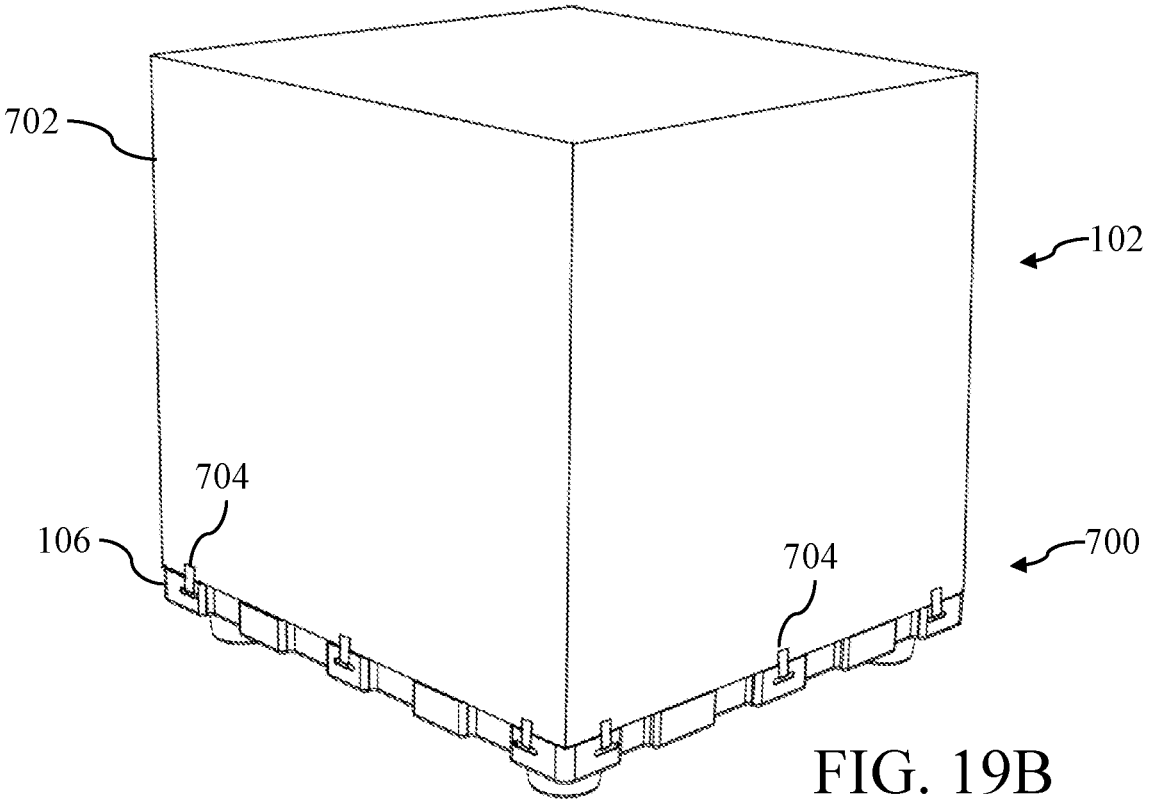
FIG. 19B shows an exemplary protective cover in use with a palletized load.

The protective tray (700) may be used with an application such as the assembled pallet (100) of FIG. 1 (e.g., inserted between the payload (102) and the pallet base (106)), or may be used with a cover (702) as illustrated in FIG. 19B. In that figure, the cover (702) is shown placed over the payload (102) and, where included, the protective tray (700). The cover (702) may be friction fit onto the payload (102) or may be held in place by its own mass, or may be coupled to the pallet base (106) via a set of straps (704). When used with the protective tray (700), the cover (702) may provide a substantially weatherproof and/or waterproof coupling with the protective tray (700) (e.g., several inches of vertical surface in tight contact), and may include additional gaskets or seals as may be desired to further reduce permeability. The cover (702) may also be used without the protective tray (700) and may still provide additional thermal protection while also obscuring the payload (102). The cover (702) may be slid over the payload (102) and, where present, the pallet top (104), or may include Velcro, zippers, buttons, or other fasteners that allow the cover (702) to be placed around the payload (102) and then closed.

Figure 19C:
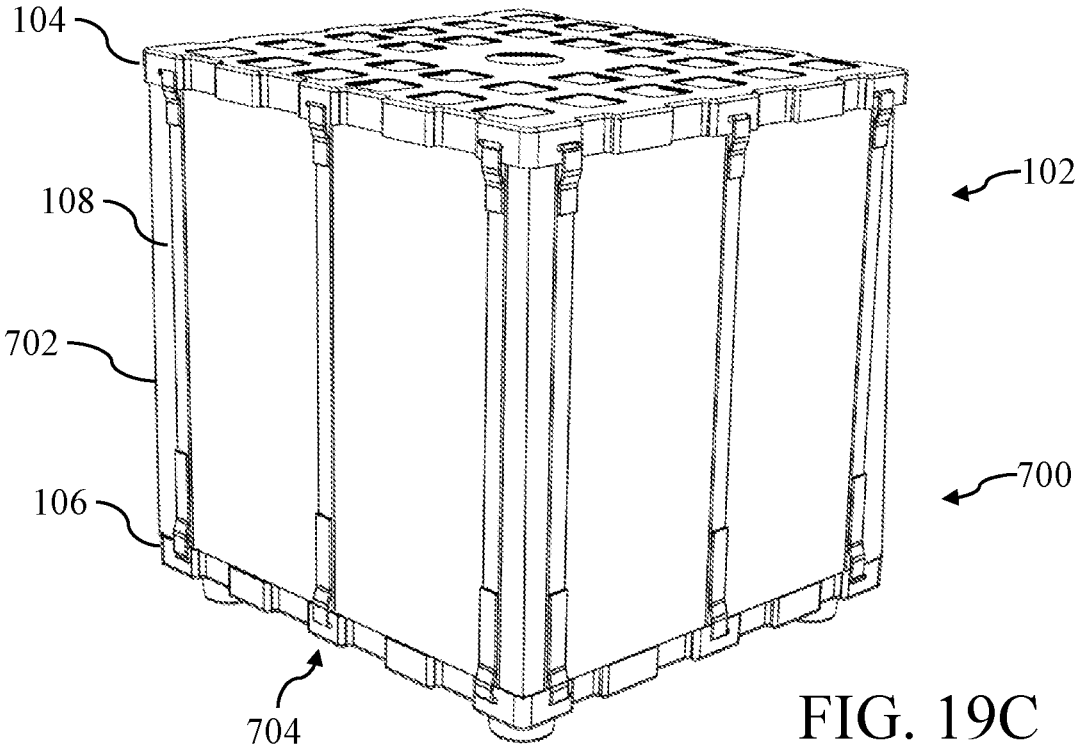
FIG. 19C shows an additional use of the protective cover of FIG. 19B.

In implementations where the cover (702) is not placed over the pallet top (104), the pallet top may instead be placed over the cover (702) as illustrated in FIG. 19C. The cover (702) may rest upon the payload (102) or may be fastened to the pallet base (106) with straps (704) as in FIG. 19B. The pallet top (104) may then be placed over the payload (102) and the cover (702) and coupled to the pallet base (106) via straps (108), as has been described above.

Figure 19D:
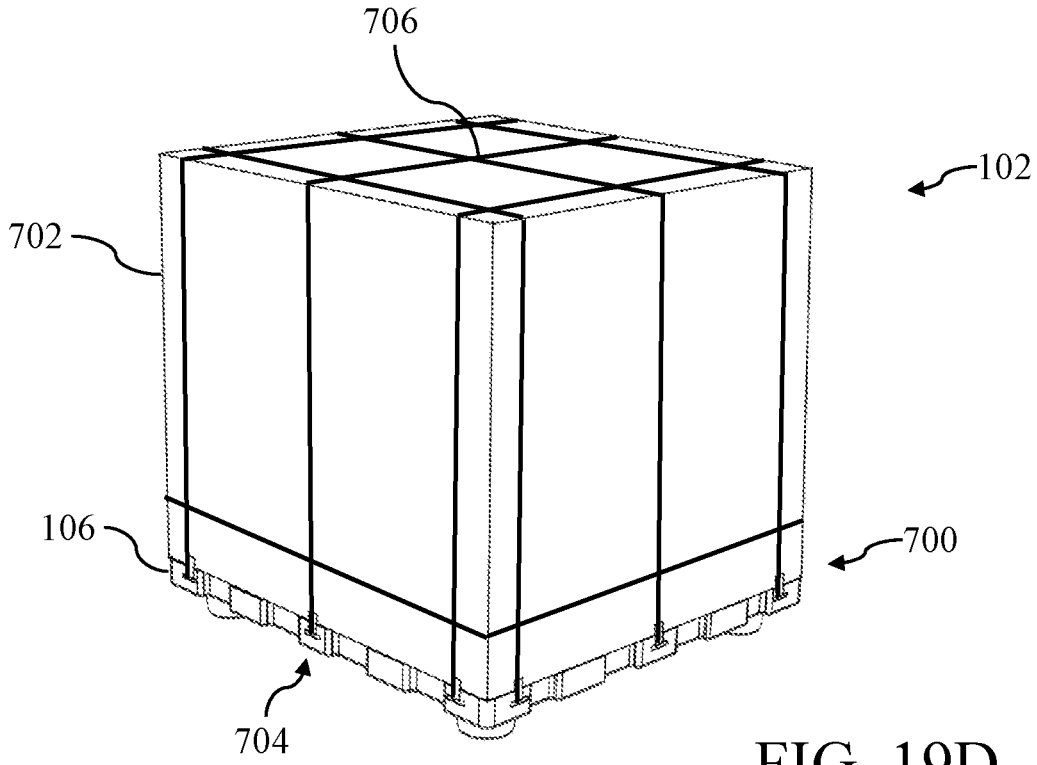
FIG. 19D shows the protective cover of FIG. 19B in use with an exemplary cargo net.
Figure 19E:
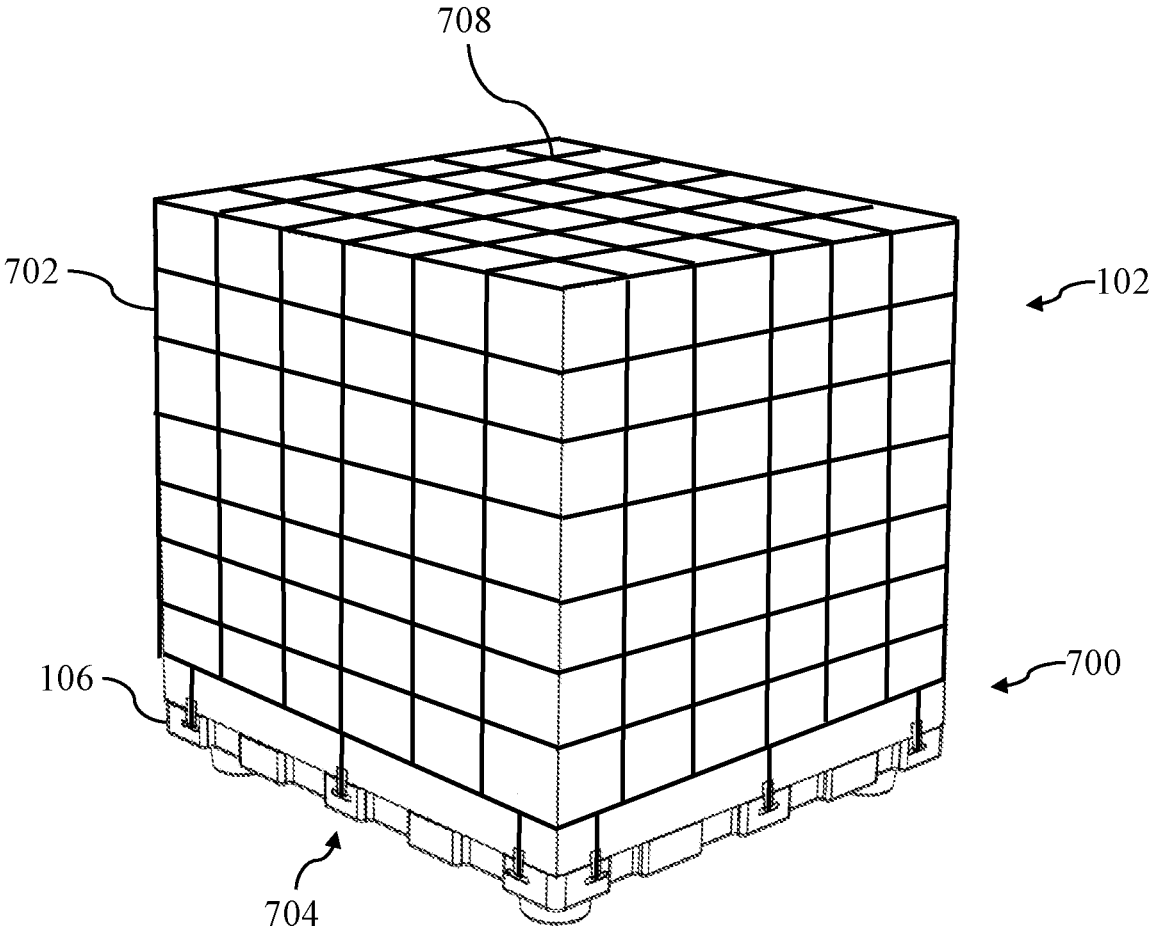
FIG. 19E shows the protective cover of FIG. 19B in use with an alternate exemplary cargo net.

FIG. 19D shows an exemplary net (706) that may be used with the pallet base (106), payload (102), and other modular components as may be desired. The net (706) may include a plurality of vertical and horizontal spans of material (e.g., organic or polymer rope providing varying degrees of flexibility), and may couple to the pallet base (106) at a plurality of points (e.g., either attaching directly to the pallet base (106) via the slots (204), or attaching to the straps (704) of the cover (702)). The net (706) may be used directly over the payload (102), or may be placed over the cover (702) or pallet top (104) as may be desired, and may also optionally be used with the protective tray (700). FIG. 19E shows an alternate net (708) that includes a larger number of vertical and horizontal spans as compared to the previously described net (706). The net (708) of FIG. 19E may otherwise be used similarly to the earlier described net (706), and may be used with one or more of the payload (102), the cover (702), the pallet base (106) and top (104), and other modular components described herein.

In addition to providing protection against environmental conditions (e.g., rain, fire, hot temperatures) covers also provide a deterrent against tampering or theft, as they cover and conceal the payload and are less readily cut and/or removed as compared to plastic wrap or other conventional palletizing materials. These passive anti-theft features may be combined with other anti-tamper features as discussed above, such as tension, proximity, or motion alarms that may detect and sound an alarm when a cover is removed, a strap is removed from a cover and no longer under tension, the cover is separated or moved a certain distance from the pallet base (106), or when other scenarios indicative of tamper or theft occur.

In some implementations, some or all of the portions of the straps (108), the net (706), or the alternate net (708) may be adhered to, stitched to, or encased within a payload cover such as the cover (702). As an example, with reference to FIG. 19C, each of the straps (108) may be coupled to the cover (702) at their midpoint or at each end, such that placement of the cover (702) and coupled straps (108) will automatically position the straps (108) at the proper location to couple to the pallet base (106) and top (104). Such an implementation would advantageously decrease pallet set up time by prepositioning the straps (108) as a function of installing the cover (702), and reduce the number of overall individual components (e.g., a single cover with integrated straps as opposed to a cover and set of 12 separate straps) to decrease the complexity of the components and likelihood of misplacing components.

As another example, with reference to FIG. 19D, a plurality of portions of the net (706) may similarly be adhered to, stitched or mechanically coupled to, or encased within the cover (702). Such an implementation would advantageously pre-position each portion of the net (706) and mitigate the need to position individual strands during installation, and would pre-position each portion of the net (706) that couples to the pallet base (106). The net (708) may similarly be adhered to, stitched or mechanically coupled to, or encased within the cover (702) in order to pre-position each individual strand of the net (708) and the points of the net (708) that coupled to the pallet base (106). As with prior examples, such implementations advantageously reduce the effort required to position the net (706, 708) both relative to the cover (702) and relative to the coupling points of the pallet base (106), and also reduce the overall number of components and complexity of the system.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLE 1

A system for palletizing cargo, wherein the system comprises a base, wherein the base comprises: a surface defining a cargo area for receiving the cargo; a rim extending about a perimeter of the cargo area; and a plurality of bumpers positioned about the rim, wherein the plurality of bumpers are configured to absorb impact to the base.

EXAMPLE 2

A system according to example 1 or any of the following examples up to example 15, wherein the cargo area includes one or more openings extending through the surface that are configured to allow airflow through the surface.

EXAMPLE 3

A system according to either one of the preceding examples or following examples up to example 15, wherein the cargo area includes one or more spacers raised relative to the surface for supporting the cargo, wherein the one or more spacers are configured to allow airflow about the one or more spacers.

EXAMPLE 4

A system according to any one of the preceding examples or following examples up to example 15, wherein the surface includes a plurality of feet extending beneath the surface to support the base.

EXAMPLE 5

A system according to any one of the preceding examples or following examples up to example 15 further comprising a top, wherein the top comprises: a surface defining a cargo area for receiving the cargo; a rim extending about a perimeter of the cargo area; and a plurality of bumpers positioned about the rim, wherein the plurality of bumpers are configured to absorb impact to the top; wherein the top is positioned opposite the base to support the cargo between the top and the base.

EXAMPLE 6

A system according to example 5 or any one of the following examples up to example 12, wherein the cargo area of the top includes one or more openings extending through the surface of the top that are configured to allow airflow through the surface of the top.

EXAMPLE 7

A system according to either one of examples 5 or 6 or any one of the following examples up to example 12, wherein the cargo area of the top includes one or more spacers raised relative to the surface of the top for supporting the cargo, wherein the one or more spacers of the top are configured to allow airflow about the one or more spacers of the top.

EXAMPLE 8

A system according to any one of examples 5 through 7 or any one of the following examples up to example 12, wherein the surface of the base includes a plurality of feet extending beneath the surface of the base to support the base; wherein the surface of the top includes a plurality of recesses corresponding to the plurality of feet of the base such that the plurality of recesses are configured to receive the plurality of feet when the top is stacked onto the base.

EXAMPLE 9

A system according to any one of examples 5 through 8 or any one of the following examples up to example 12, further comprising one or more guards extending between the top and the base, wherein a height of the one or more guards is adjustable to adjust a distance between the top and the base.

EXAMPLE 10

A system according to any one of examples 5 through 9 or any one of the following examples up to example 12, further comprising a plurality of straps extending between the top and base to connect the top with the base, wherein the plurality of straps are adjustable to selectively fix the position of the top relative to the base.

EXAMPLE 11

A system according to example 10 or any one of the following examples up to example 12, wherein the rim of each of the top and the base include a plurality of slots configured to receive the plurality of straps therethrough.

EXAMPLE 12

A system according to either one of examples 10 or 11, wherein a force of each strap of the plurality of straps is applied along a vertical axis when the plurality of straps are adjusted.

EXAMPLE 13

A system according to any one of the preceding examples or following examples up to example 15, further comprising one or more sensor modules that are operable to perform one or more of communication, location detection, tamper detection, and environment detection.

EXAMPLE 14

A system according to any one of the preceding examples or following examples up to example 15, further comprising a cover positioned over the cargo to provide protection for the cargo.

EXAMPLE 15

A system according to example 14 further comprising a net for securing the cargo to the base, wherein the net is attached to the cover.

EXAMPLE 16

A pallet assembly for palletizing cargo comprising: a base defining a first cargo area for receiving the cargo; a top defining a second cargo area for receiving the cargo, wherein the top is positioned opposite of the base to align the first cargo area with the second cargo area for storing the cargo therebetween; and a plurality of straps coupling the base with the top, wherein the plurality of straps are adjustable to maintain the position of the top relative to the base.

EXAMPLE 17

A pallet assembly according to example 16, wherein the base of the pallet assembly is configured to be positioned on the top of another pallet assembly such that the pallet assembly is stackable with the other pallet assembly.

EXAMPLE 18

A pallet support for supporting cargo comprising: a surface defining a cargo area for receiving the cargo, wherein the surface includes one or more openings extending through the surface and one or more spacers raised relative to the surface; a rim extending about a perimeter of the cargo area; and a plurality of bumpers positioned about the rim, wherein the plurality of bumpers are configured to absorb impact to the support.

EXAMPLE 19

A pallet support according to examples 18 or 20, wherein a first pallet support is positioned opposite to a second pallet support to store the cargo therebetween.

EXAMPLE 20

A pallet support of example 19, wherein a plurality of straps are couplable between the first pallet support and the second pallet support to maintain the position of the first pallet support relative to the second pallet support.

I claim:

1. A system for palletizing cargo, wherein the system comprises a base, wherein the base comprises:

a surface defining a cargo area for receiving the cargo;

a rim extending about a rectangular perimeter of the cargo area; and a plurality of bumpers positioned about the rim, wherein the plurality of bumpers are configured to absorb impact to the base, wherein the plurality of bumpers includes corner bumpers and side bumpers, wherein each corner bumper extends outwardly from a first side surface of the rim and extends around a corner of the rim to a second side surface of the rim; wherein the side bumpers are discretely disposed on the side surfaces of the rim, and wherein the side bumpers extend outwardly from the side surface of the rim, wherein each of the side bumpers and the side surface of the rim define an opening that extends vertically between the side bumper and the side surface of the rim.

2. The system of claim 1, wherein the cargo area includes one or more openings extending through the surface that are configured to allow airflow through the surface.

3. The system of claim 1, wherein the cargo area includes one or more spacers raised relative to the surface for supporting the cargo, wherein the one or more spacers are configured to allow airflow about the one or more spacers.

4. The system of claim 1, wherein the surface includes a plurality of feet extending beneath the surface to support the base.

5. The system of claim 1 further comprising a top, wherein the top comprises:

a surface defining a cargo area for receiving the cargo;

a rim extending about a perimeter of the cargo area; and a plurality of bumpers positioned about the rim, wherein the plurality of bumpers are configured to absorb impact to the top;

wherein the top is positioned opposite the base to support the cargo between the top and the base.

6. The system of claim 5, wherein the cargo area of the top includes one or more openings extending through the surface of the top that are configured to allow airflow through the surface of the top.

7. The system of claim 5, wherein the cargo area of the top includes one or more spacers raised relative to the surface of the top for supporting the cargo, wherein the one or more spacers of the top are configured to allow airflow about the one or more spacers of the top.

8. The system of claim 5, wherein the surface of the base includes a plurality of feet extending beneath the surface of the base to support the base; wherein the surface of the top includes a plurality of recesses corresponding to the plurality of feet of the base such that the plurality of recesses are configured to receive the plurality of feet when the top is stacked onto the base.

9. The system of claim 5 further comprising one or more guards extending between the top and the base, wherein a height of the one or more guards is adjustable to adjust a distance between the top and the base.

10. The system of claim 5 further comprising a plurality of straps extending between the top and base to connect the top with the base, wherein the plurality of straps are adjustable to selectively fix the position of the top relative to the base.

11. The system of claim 10, wherein the rim of each of the top and the base include a plurality of slots configured to receive the plurality of straps therethrough.

12. The system of claim 10, wherein a force of each strap of the plurality of straps is applied along a vertical axis when the plurality of straps are adjusted.

13. The system of claim 1 further comprising one or more sensor modules that are operable to perform one or more of communication, location detection, tamper detection, and environment detection.

14. The system of claim 1 further comprising a cover positioned over the cargo to provide protection for the cargo.

15. The system of claim 14 further comprising a net for securing the cargo to the base, wherein the net is attached to the cover.

16. A pallet assembly for palletizing cargo comprising:

a base defining a first cargo area for receiving the cargo, wherein the base includes a base slot positioned on an outside perimeter of the base;

a top defining a second cargo area for receiving the cargo, wherein the top is positioned opposite of the base to align the first cargo area with the second cargo area for storing the cargo therebetween, wherein the top includes a top slot positioned on an outside perimeter of the top;

a plurality of bumpers positioned about a rim, wherein the plurality of bumpers is configured to absorb impact to the pallet assembly, wherein the plurality of bumpers comprises side bumpers discretely disposed on a side surface of the rim, and wherein the side bumpers extend outwardly from the side surface of the rim, wherein each of the side bumpers and the side surface of the rim define an opening that extends vertically between the side bumper and the side surface of the rim; and a plurality of straps coupling the base with the top extending distally from the base slot to the top slot, wherein the plurality of straps are adjustable to maintain the position of the top relative to the base, wherein a force of each strap of the plurality of straps is applied along a vertical axis between the base slot and the top slot, wherein the top includes a structure that is different than the base.

17. The pallet assembly of claim 16, wherein the base of the pallet assembly is configured to be positioned on the top of another pallet assembly such that the pallet assembly is stackable with the other pallet assembly.

18. A pallet support for supporting cargo comprising:

a surface defining a cargo area for receiving the cargo, wherein the surface includes one or more openings extending through the surface and one or more spacers raised relative to the surface;

a rim extending about a perimeter of the cargo area, wherein the rim includes a plurality of corners and a plurality of side surfaces positioned between each of the corners; and a plurality of bumpers positioned about the rim, wherein the plurality of bumpers is configured to absorb impact to the support, wherein the plurality of bumpers comprise side bumpers discretely disposed on the side surfaces of the rim, and wherein the side bumpers extend outwardly from the side surface of the rim, wherein each of the side bumpers and the side surface of the rim define an opening that extends vertically between the side bumper and the side surface of the rim.

19. The pallet support of claim 18, wherein a first pallet support is positioned opposite to a second pallet support to store the cargo therebetween.

20. The pallet support of claim 19, wherein a plurality of straps are couplable between the first pallet support and the second pallet support to maintain the position of the first pallet support relative to the second pallet support.

* * * * *